US010612208B2

(12) United States Patent
Maruyama et al.

(10) Patent No.: US 10,612,208 B2
(45) Date of Patent: Apr. 7, 2020

(54) ATTACHMENT HOLDER FOR CONSTRUCTION EQUIPMENT AND CONSTRUCTION MACHINE

(71) Applicant: Shun Maruyama, Saitama-Pref (JP)

(72) Inventors: Shun Maruyama, Saitama-Pref (JP); Mitsuru Maruyama, Tokyo (JP); Toshio Yoshida, Tokyo (JP); Naoto Nanbu, Kanagawa-Pref (JP)

(73) Assignee: Shun Maruyama, Saitama (JP)

( * ) Notice: Subject to any disclaimer, the term of this patent is extended or adjusted under 35 U.S.C. 154(b) by 0 days.

(21) Appl. No.: 16/296,680

(22) Filed: Mar. 8, 2019

(65) Prior Publication Data

US 2019/0284779 A1 Sep. 19, 2019

(30) Foreign Application Priority Data

Mar. 15, 2018 (JP) ..... 2018-47417

(51) Int. Cl.
*E02F 3/36* (2006.01)
*E02F 3/30* (2006.01)

(52) U.S. Cl.
CPC ..... *E02F 3/3618* (2013.01); *E02F 3/30* (2013.01); *E02F 3/3622* (2013.01)

(58) Field of Classification Search
CPC ..... E02F 3/40; E02F 3/3618
See application file for complete search history.

(56) References Cited

U.S. PATENT DOCUMENTS

2004/0000077 A1* 1/2004 Fatemi ..... E02F 3/3622 37/468

FOREIGN PATENT DOCUMENTS

| | | |
|---|---|---|
| JP | 2006-169886 | 6/2006 |
| JP | 3134696 | 8/2007 |
| JP | 2011-231505 | 11/2011 |
| JP | 6211324 | 10/2017 |

* cited by examiner

*Primary Examiner* — Ronald P Jarrett
(74) *Attorney, Agent, or Firm* — Wenderoth, Lind & Ponack, L.L.P.

(57) ABSTRACT

An attachment holder for construction equipment includes a movable-side pin guidance surface configured to guide a movable-side coupling pin to a movable-side pin accommodation portion. The attachment holder also includes an excessive closure prevention portion configured to prevent a movable-side jaw from closing excessively with respect to a stationary-side jaw to enable the movable-side coupling pin to come into contact with the movable-side pin guidance surface, whether the movable-side coupling pin is of an attachment for the construction equipment that has a minimum pin-to-pin spacing or a maximum pin-to-pin spacing, in a case in which the movable-side coupling pin is to be accommodated in the movable-side pin accommodation portion by operating, for example, an arm of the construction machine so as to move the movable-side jaw closer to the movable-side coupling pin after a stationary-side coupling pin is accommodated in a stationary-side pin accommodation portion.

8 Claims, 18 Drawing Sheets

ATTACHMENT HOLDER FOR CONSTRUCTION EQUIPMENT AND CONSTRUCTION MACHINE

BACKGROUND OF THE INVENTION

1. Field of the Invention

The present invention relates to an attachment holder for construction equipment, such as a power shovel, and also relates to a construction machine.

2. Description of the Related Art

There have been proposed several mechanisms for a stationary-side jaw and a movable-side jaw of an attachment holder to be used for mounting an attachment such as a bucket on a construction machine such as a power shovel. The attachment has two coupling pins disposed with a predetermined spacing therebetween, and the stationary-side jaw and the movable-side jaw have respective open portions to be engaged with the coupling pins. After the engagement, one of the proposed mechanisms urges the movable-side jaw to move away from the stationary-side jaw by using, for example, a regulation member and a coil spring (for example, see Japanese Unexamined Patent Application Publication No. 2011-231505). Another mechanism drives a screw and thereby urges the movable-side jaw to move away from the stationary-side jaw (for example, see Japanese Registered Utility Model No. 3134696). Another mechanism uses a dedicated bucket cylinder that urges the movable-side jaw to move away from the stationary-side jaw (for example, see Japanese Unexamined Patent Application Publication No. 2006-169886). Another mechanism is configured to close a movable-side pin accommodation portion and a stationary-side pin accommodation portion by using a stationary-side closer portion and a movable-side closer portion (for example, see Japanese Patent 6211324).

However, the attachment holders for construction equipment described in Japanese Unexamined Patent Application Publication No. 2011-231505, Japanese Registered Utility Model No. 3134696, and Japanese Unexamined Patent Application Publication No. 2006-169886, have a disadvantage. In other words, after the engagement of the coupling pins with the stationary-side jaw and the movable-side jaw having the opening portions, these attachment holders need to use a regulation mechanism that urges the movable-side jaw to move away from the stationary-side jaw by using, for example, the regulation member and coil spring, the screw mechanism, or the bucket cylinder, which leads to an increase in cost.

In addition, in the case of the screw mechanism or the bucket cylinder or the like that urges the movable-side jaw to move away from the stationary-side jaw, the coupling pins may be slipped off from the opening portions of the movable-side jaw and the stationary-side jaw.

On the other hand, the attachment holder for construction equipment described in Japanese Patent No. 6211324 is configured such that the opening portions of the stationary-side jaw and the movable-side jaw are closed by the stationary-side closer portion and the movable-side closer portion, respectively, and the coupling pins are not likely to disengage. However, it requires skills to accommodate the coupling pins appropriately in the stationary-side jaw and the movable-side jaw.

SUMMARY OF THE INVENTION

Accordingly, it is an object of the present invention to provide an attachment holder for construction equipment and a construction machine that do not require a costly regulation mechanism, such as a screw mechanism or a bucket cylinder, that regulates opening operation or an opening angle of a movable-side jaw with respect to a stationary-side jaw and that can prevent coupling pins from being detached from the stationary-side jaw and the movable-side jaw.

According to an aspect of the invention, an attachment holder for construction equipment is provided for mounting an attachment such as a bucket on a construction machine such as a power shovel in such a manner that a stationary-side coupling pin and a movable-side coupling pin that are disposed on the attachment with a predetermined spacing therebetween are accommodated respectively in a stationary-side pin accommodation portion of a stationary-side jaw that is joined to an end of an arm of the construction machine and in a movable-side pin accommodation portion of a movable-side jaw that is joined, via a movable-side jaw link, to an end of a piston that retractably extends from a bucket cylinder disposed in the arm of the construction machine, and subsequently an opening of the stationary-side pin accommodation portion and an opening of the movable-side pin accommodation portion are closed respectively by a stationary-side closer portion and by a movable-side closer portion. The attachment holder for construction equipment includes a movable-side pin guidance surface that is disposed outside the opening of the movable-side pin accommodation portion of the movable-side jaw and that comes into contact with the movable-side coupling pin and guides the movable-side coupling pin until the movable-side coupling pin is accommodated in the movable-side pin accommodation portion whether the movable-side coupling pin is a movable-side coupling pin of an attachment for construction equipment that has a minimum pin-to-pin spacing between the stationary-side coupling pin and the movable-side coupling pin or a maximum pin-to-pin spacing. The attachment holder for construction equipment also includes an excessive closure prevention portion that prevents the movable-side jaw from closing excessively with respect to the stationary-side jaw to enable the movable-side coupling pin to come into contact with the movable-side pin guidance surface, whether the movable-side coupling pin is a movable-side coupling pin of an attachment for construction equipment that has a minimum pin-to-pin spacing between the stationary-side coupling pin and the movable-side coupling pin or a maximum pin-to-pin spacing, in a case in which the movable-side coupling pin is to be accommodated in the movable-side pin accommodation portion of the movable-side jaw by actuating a hydraulic cylinder or the like of the construction machine so as to move the movable-side jaw closer to the movable-side coupling pin after the stationary-side coupling pin is accommodated in the stationary-side pin accommodation portion of the stationary-side jaw.

Accordingly, the attachment holder for construction equipment does not require the regulation mechanism, such as the screw mechanism or the bucket cylinder, that regulates opening operation and the opening angle of the movable-side jaw with respect to the stationary-side jaw. This leads to cost reduction. In addition, the attachment holder can reliably prevent the coupling pins accommodated in the stationary-side jaw and the movable-side jaw from being detached.

The attachment holder for construction equipment may further include an excessive opening prevention portion. In the attachment holder for construction equipment, the stationary-side jaw and the movable-side jaw may be configured to pivotally move about a pivot shaft, and the excessive opening prevention portion may prevent the movable-side pin accommodation portion of the movable-side jaw from excessively opening pivotally about the pivot shaft with respect to the stationary-side pin accommodation portion of the stationary-side jaw. The stationary-side jaw and the movable-side jaw may pivotally move about the pivot shaft relative to each other by actuating the bucket cylinder disposed in the arm of the construction machine and thereby cause the stationary-side pin accommodation portion and the movable-side pin accommodation portion to move closer to, and away from, each other and enable the stationary-side pin accommodation portion to accommodate the stationary-side coupling pin and also enable the movable-side pin accommodation portion to accommodate the movable-side coupling pin.

In the attachment holder for construction equipment, the excessive closure prevention portion may be part of a stopper that is welded to the stationary-side jaw at a position near the pivot shaft and that is contactable with a base portion of the movable-side jaw near the pivot shaft. Whether the movable-side coupling pin is a movable-side coupling pin of an attachment for construction equipment that has a minimum pin-to-pin spacing between the stationary-side coupling pin and the movable-side coupling pin or a maximum pin-to-pin spacing, the movable-side coupling pin may be brought into contact with the movable-side pin guidance surface in a case in which the movable-side coupling pin is to be accommodated in the movable-side pin accommodation portion of the movable-side jaw by actuating a hydraulic cylinder or the like of the construction machine so as to move the movable-side jaw closer to the movable-side coupling pin while the base portion of the movable-side jaw near the pivot shaft is in contact with the stopper of the stationary-side jaw after the stationary-side coupling pin is accommodated in the stationary-side pin accommodation portion of the stationary-side jaw.

In the attachment holder for construction equipment, the excessive closure prevention portion may include respective body portions of the stationary-side jaw and the movable-side jaw, the body portions opposing each other. Whether the movable-side coupling pin is a movable-side coupling pin of an attachment for construction equipment that has a minimum pin-to-pin spacing between the stationary-side coupling pin and the movable-side coupling pin or a maximum pin-to-pin spacing, the movable-side coupling pin may be brought into contact with the movable-side pin guidance surface in a case in which the movable-side coupling pin is to be accommodated in the movable-side pin accommodation portion of the movable-side jaw by actuating a hydraulic cylinder or the like of the construction machine so as to move the movable-side jaw closer to the movable-side coupling pin while the body portion of the stationary-side jaw and the body portion of the movable-side jaw are in contact with each other after the stationary-side coupling pin is accommodated in the stationary-side pin accommodation portion of the stationary-side jaw.

A construction machine according to another aspect of the invention includes the attachment holder for construction equipment configured as described above.

DESCRIPTION OF THE PREFERRED EMBODIMENTS

An attachment holder for construction equipment and a construction machine according to an embodiment of the invention will be described with reference to the drawings. Note that embodiments described below are examples of the invention, and accordingly the invention is not limited to the embodiments below and may be modified and altered within the technical scope of the invention.

Figure 1:
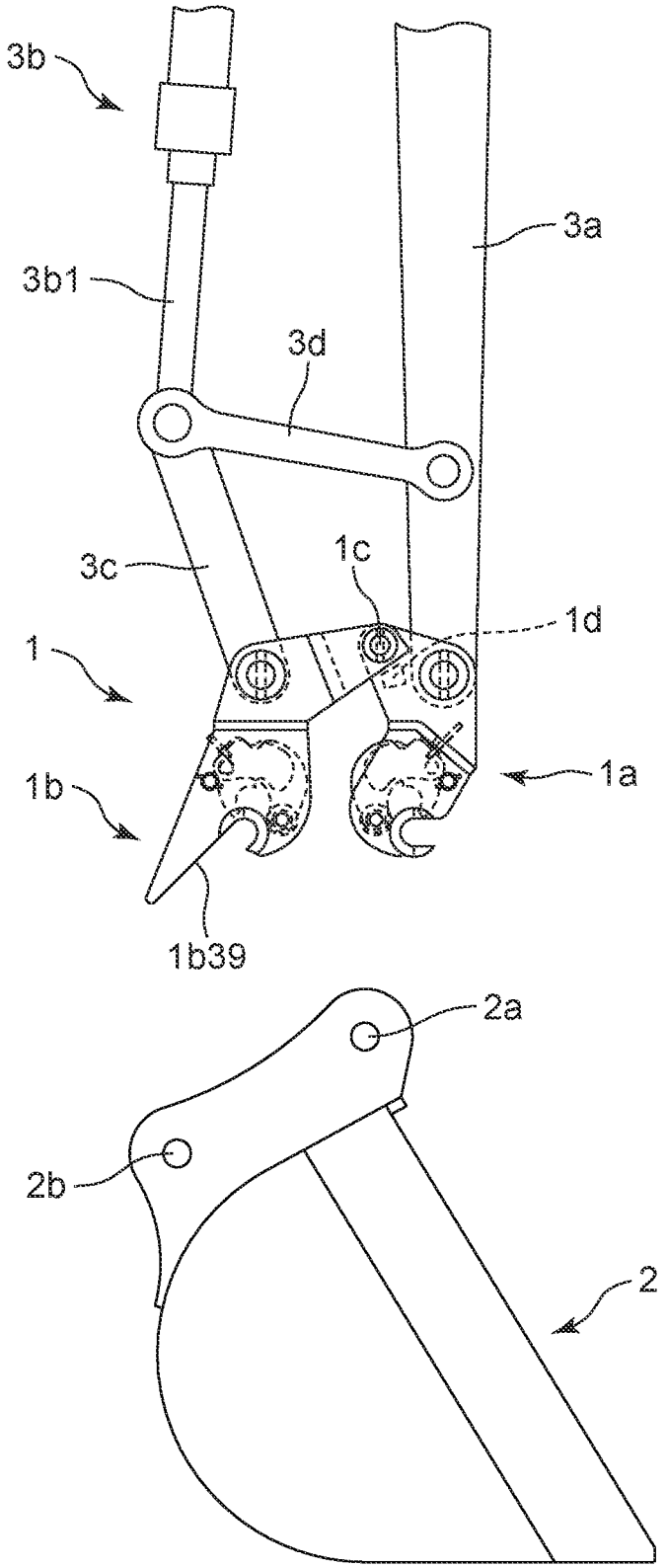
FIG. 1 is a front view illustrating a state in which a bucket is attached to an arm by using an attachment holder for construction equipment according to an embodiment of the invention.

As illustrated in FIG. 1, an attachment holder 1 for construction equipment according to the embodiment is used for attaching a bucket, which is an example of an attachment. The bucket has two coupling pins, in other words, a stationary-side coupling pin 2*a* and a movable-side coupling pin 2*b*, that are disposed in a rear portion of the bucket 2 with a predetermined spacing therebetween. The attachment holder includes a stationary-side jaw 1*a* that is mounted on an end of an arm 3*a* of a construction machine such as a power shovel (not illustrated) and a movable-side jaw 1*b* that is mounted, via a movable-side jaw link 3*c*, on an end of a piston 3*b*1 that extends retractably from a bucket cylinder 3*b*. When the bucket 2 is attached, the stationary-side coupling pin 2*a* is engaged with the stationary-side jaw 1*a* and engaging the movable-side coupling pin 2*b* is engaged with the movable-side jaw 1*b*.

In FIG. 1, reference symbol 3*d* denotes an arm link that has a proximal end pivotally connected to the arm 3*a* and a distal end pivotally connected to a proximal end of the movable-side jaw link 3*c* and also to the end of the piston 3*b*1 that extends retractably from the bucket cylinder 3*b*. Note that configurations and connection structures of the bucket 2, the arm 3*a*, the bucket cylinder 3*b*, the movable-side jaw link 3*c*, the arm link 3*d*, or the like, are known except for the attachment holder 1. In addition, the attachment holder 1 is applicable to an attachment other than the bucket 2, such as a drill, a pile driver, and a crusher.

Configuration of Attachment Holder 1 for Construction Equipment

As illustrated in FIGS. 1 to 8, the attachment holder 1 of the embodiment includes the stationary-side jaw 1*a* and the movable-side jaw 1*b* that are pivotally movable about a pivot shaft 1*c*. The attachment holder 1 is configured such that the stationary-side jaw 1*a* is connected to the stationary-side coupling pin 2*a* and the movable-side jaw 1*b* is connected to the movable-side coupling pin 2*b* by moving the stationary-side jaw 1*a* and the movable-side jaw 1*b* pivotally about the pivot shaft 1*c*.

Stationary-Side Jaw 1*a*

As illustrated in FIG. 1, a stationary-side link plate 1*a*1 of the stationary-side jaw 1*a* is pivotally connected to the end portion of the arm 3*a* of a construction machine via a coupling pin 3*a*1 for connection of a stationary-side jaw 1*a*. A stationary-side hook plate 1*a*3 is attached to a bottom portion of the stationary-side link plate 1*a*1 via a stationary-side horizontal base plate 1*a*2.

The stationary-side hook plate 1*a*3 includes a semicircular engaging portion 1*a*31, a locking pin hole 1*a*32, a first semicircular pivotal closer member 1*a*35 and a second semicircular pivotal closer member 1*a*36, and a handle 1*a*38. The semicircular engaging portion 1*a*31 has a substantially semicircular cross section with a partially open portion and is shaped so as to fit the outer periphery of the stationary-side coupling pin 2*a*. The semicircular engaging portion 1*a*31 defines a stationary-side pin accommodation portion 1*a*30 and engages the stationary-side coupling pin 2*a*. The locking pin hole 1*a*32 receives a locking pin 1*a*33. The first semicircular pivotal closer member 1*a*35 and the second semicircular pivotal closer member 1*a*36, which are rotatably connected to each other about a pivot pin 1*a*37, move pivotally about a pivot shaft 1*a*34 and thereby close the opening of the stationary-side pin accommodation portion 1a30 so as to join the stationary-side coupling pin 2a to the stationary-side jaw 1a and to lock the stationary-side coupling pin 2a. The first semicircular pivotal closer member 1a35 and the second semicircular pivotal closer member 1a36 serve as a stationary-side closer portion of the invention.

A base portion of the first semicircular pivotal closer member 1a35 is pivotally joined to an end portion of the second semicircular pivotal closer member 1a36 via the pivot pin 1a37, which will be described later. The first semicircular pivotal closer member 1a35 has a semicircular abutting portion 1a35a at an end thereof, and the semicircular abutting portion 1a35a is shaped so as to fit the outer periphery of the stationary-side coupling pin 2a. The semicircular abutting portion 1a35a and the semicircular engaging portion 1a31 of the stationary-side jaw 1a hold and support the stationary-side coupling pin 2a.

While the end portion of the second semicircular pivotal closer member 1a36 is pivotally joined to the base portion of the first semicircular pivotal closer member 1a35 via the pivot pin 1a37, the base portion of the second semicircular pivotal closer member 1a36 is pivotally joined to the stationary-side jaw 1a via the pivot shaft 1a34. When the stationary-side coupling pin 2a is held and supported between the semicircular abutting portion 1a35a of the first semicircular pivotal closer member 1a35 and the semicircular engaging portion 1a31 of the stationary-side jaw 1a and the locking pin 1a33 is inserted in the locking pin hole 1a32, a portion of the inner periphery 1a36a of the second semicircular pivotal closer member 1a36 between the pivot pin 1a37 and the pivot shaft 1a34 abuts against the outer periphery 1a31a of the semicircular engaging portion 1a31. The second semicircular pivotal closer member 1a36 thereby receives forces acting on the stationary-side coupling pin 2a via the semicircular engaging portion 1a31. Note that when the stationary-side coupling pin 2a is held and supported, end portions of both sides of the first semicircular pivotal closer member 1a35 may be in contact with end portions of both sides of the semicircular engaging portion 1a31 of the stationary-side jaw 1a. In the present embodiment, however, the end portions of both sides of the first semicircular pivotal closer member 1a35 are not in contact with the end portions of both sides of the semicircular engaging portion 1a31 of the stationary-side jaw 1a, which will be described later with reference to FIGS. 8 and 9. The stationary-side coupling pin 2a is held tightly and securely on both sides by respective inner peripheries of the first semicircular pivotal closer member 1a35 and the semicircular engaging portion 1a31.

In the embodiment, a stopper 1d is joined to the stationary-side link plate 1a1 of the stationary-side jaw 1a by welding, bolt connection, or the like. The stopper 1d has respective corner portions that function as an excessive closure prevention portion 1d1 and an excessive opening prevention portion 1d2.

Figure 7:
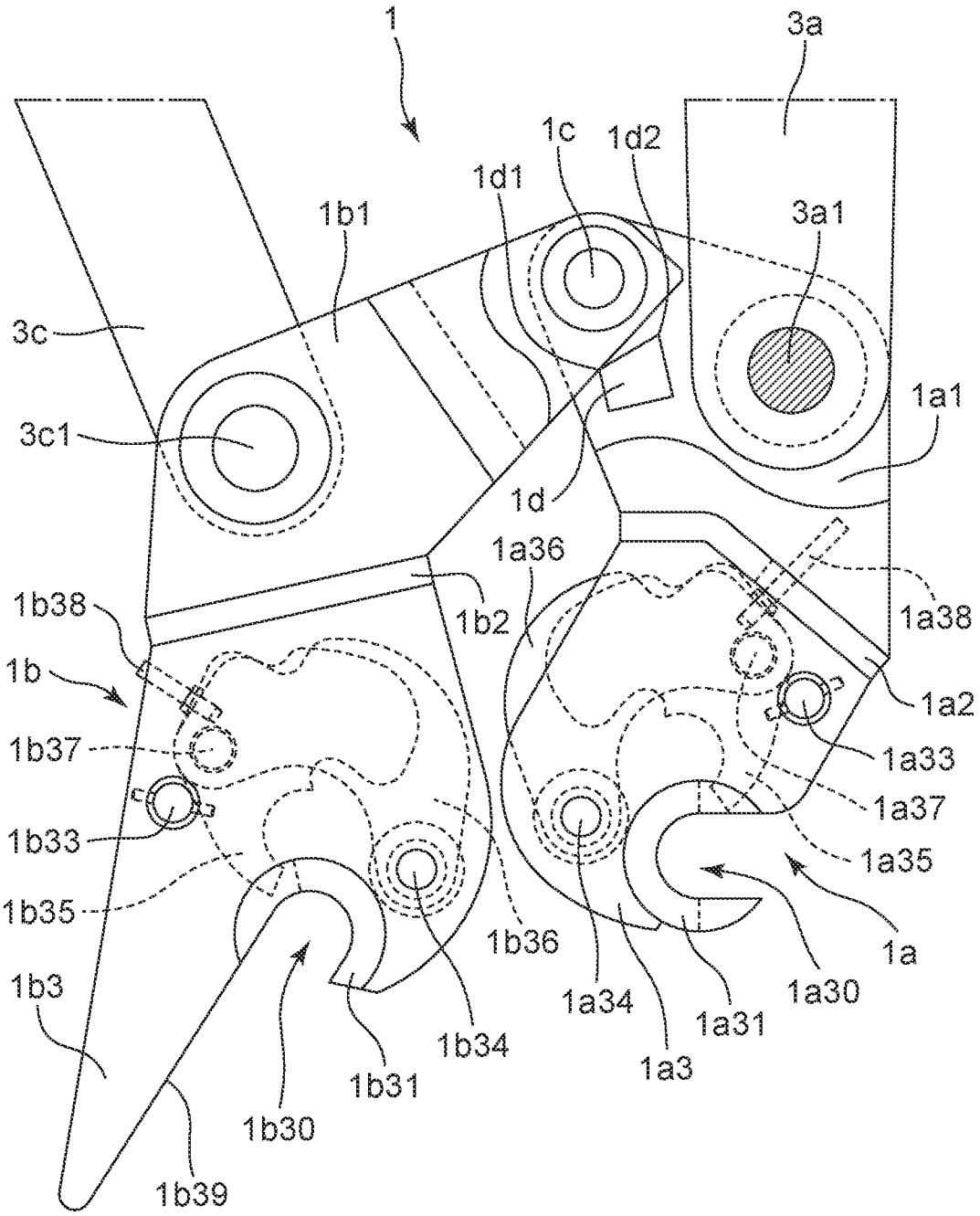
FIG. 7 is a partial front view illustrating a state in which an excessive closure prevention portion of a stopper disposed in a stationary-side jaw abuts against a movable-side jaw and thereby the movable-side jaw is prevented from closing excessively with respect to the stationary-side jaw in the attachment holder for construction equipment according to the embodiment.

As illustrated in FIG. 7, the excessive closure prevention portion 1d1 of the stopper 1d comes into contact with a bottom portion of the movable-side link plate 1b1 of the movable-side jaw 1b near the pivot shaft 1c, and thereby prevents the movable-side jaw 1b from closing excessively with respect to the stationary-side jaw 1a when the movable-side coupling pin 2b is to be accommodated in the movable-side pin accommodation portion 1b30, which is the inside of the semicircular engaging portion 1b31 of the movable-side jaw 1b, by actuating the bucket cylinder 3b disposed in the arm 3a of a construction machine so as to move the movable-side jaw 1b closer to the movable-side coupling pin 2b after the stationary-side coupling pin 2a is accommodated in the stationary-side pin accommodation portion 1a30, which is the inside of the semicircular engaging portion 1a31 of the stationary-side jaw 1a. This point will be described later. This enables the movable-side pin guidance surface 1b39 to come into contact with the movable-side coupling pin 2b and also enables the movable-side pin guidance surface 1b39 to guide the movable-side coupling pin 2b to the movable-side pin accommodation portion 1b30 whether an attachment to be attached to the construction machine has a minimum pin-to-pin spacing between the stationary-side coupling pin 2a and the movable-side coupling pin 2b or a maximum pin-to-pin spacing.

Figure 8:
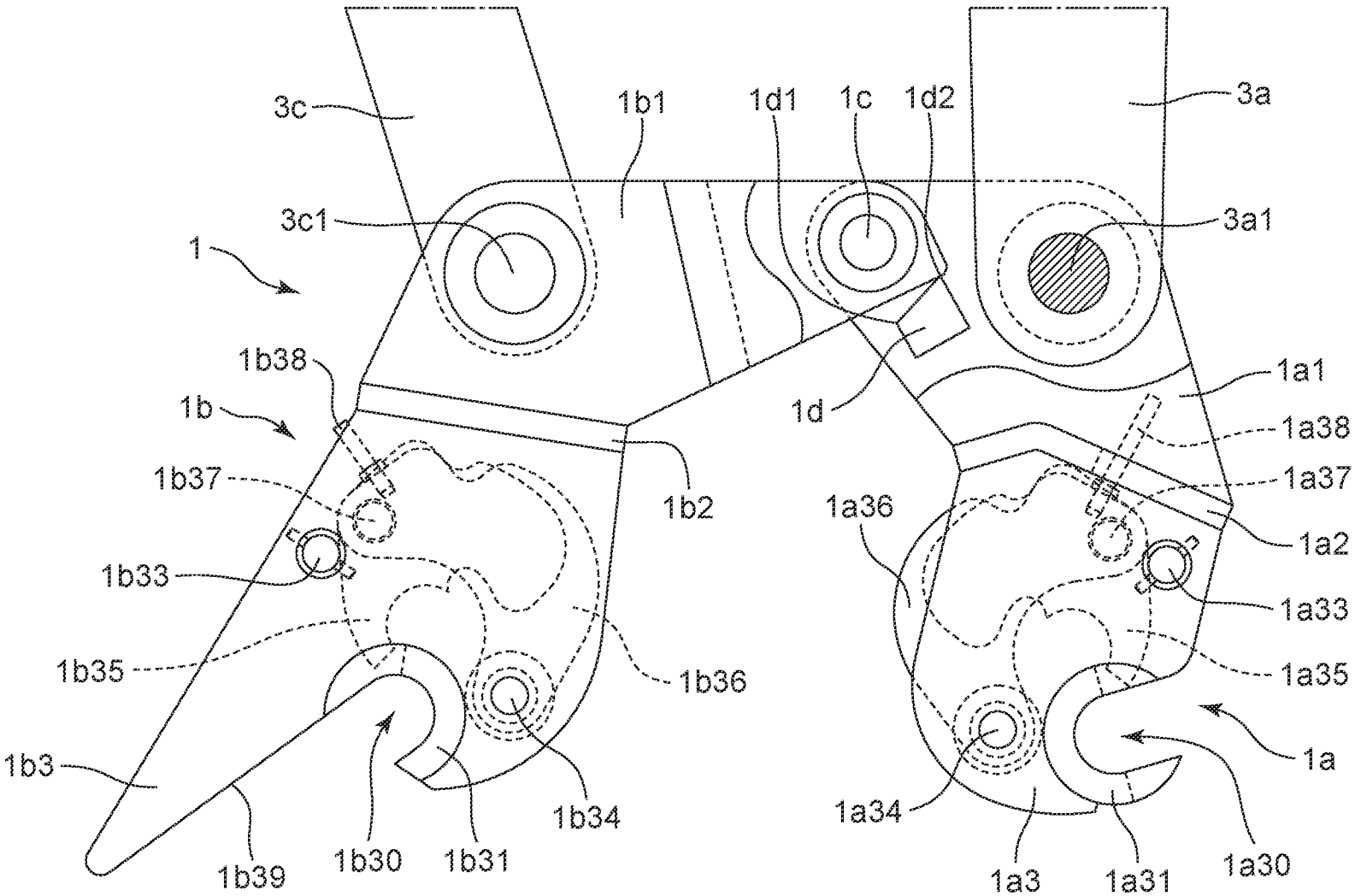
FIG. 8 is a partial front view illustrating a state in which an excessive opening prevention portion of the stopper disposed in a stationary-side jaw abuts against a movable-side jaw and thereby the movable-side jaw is prevented from opening excessively with respect to the stationary-side jaw in the attachment holder for construction equipment according to the embodiment.

As illustrated in FIG. 8, the excessive opening prevention portion 1d2 of the stopper 1d abuts against a bottom portion of the movable-side link plate 1b1 of the movable-side jaw 1b near the pivot shaft 1c, and thereby prevents the movable-side pin accommodation portion 1b30 of the movable-side jaw 1b from opening excessively with respect to the stationary-side pin accommodation portion 1a30 of the stationary-side jaw 1a when the movable-side jaw 1b pivotally moves about the pivot shaft 1c with respect to the stationary-side jaw 1a.

Movable-Side Jaw 1b

As illustrated in FIG. 1, the movable-side jaw 1b is joined, via the movable-side jaw link 3c, to the end portion of the piston 3b1 that retractably extends from the bucket cylinder 3b and is disposed so as to move pivotally about the pivot shaft 1c with respect to the stationary-side jaw 1a. As illustrated mainly in FIGS. 4 to 6, the movable-side link plate 1b1 is pivotally connected to the end portion of the movable-side jaw link 3c via a coupling pin 3c1. A movable-side hook plate 1b3 is attached to a bottom portion of the movable-side link plate 1b1 via a movable-side horizontal base plate 1b2.

The movable-side hook plate 1b3 includes a semicircular engaging portion 1b31, a locking pin hole 1b32, a first semicircular pivotal closer member 1b35 and a second semicircular pivotal closer member 1b36, and a handle 1b38. The semicircular engaging portion 1b31 has a substantially semicircular cross section with a partially opening portion and is shaped so as to fit the outer periphery of the movable-side coupling pin 2b. The semicircular engaging portion 1b31 defines a movable-side pin accommodation portion 1b30 and engages the movable-side coupling pin 2b. The locking pin hole 1b32 receives a locking pin 1b33. The first semicircular pivotal closer member 1b35 and the second semicircular pivotal closer member 1b36, which are rotatably connected to each other by a pivot pin 1b37, move pivotally about a pivot shaft 1b34 and thereby close the opening of the movable-side pin accommodation portion 1b30 so as to join the movable-side coupling pin 2b to the movable-side jaw 1b and to lock the movable-side coupling pin 2b. The first semicircular pivotal closer member 1b35 and the second semicircular pivotal closer member 1b36 serve as a movable-side closer portion of the invention. Note that the first semicircular pivotal closer member 1b35 and the second semicircular pivotal closer member 1b36 of the movable-side hook plate 1b3 are formed similarly to the first semicircular pivotal closer member 1a35 and the second semicircular pivotal closer member 1a36 of the stationary-side hook plate 1a3. When the movable-side coupling pin 2b is held and supported between the semicircular abutting portion of the first semicircular pivotal closer member 1b35 and the semicircular engaging portion 1b31 of the movable-side jaw 1b, a portion of the inner periphery of the second semicircular pivotal closer member 1b36 between the pivot pin 1b37 and the pivot shaft 1b34 abuts against the outer periphery of the semicircular engaging portion 1b31. The second semicircular pivotal closer member 1b36 thereby receives forces acting on the movable-side coupling pin 2b via the semicircular engaging portion 1b31.

Figure 2:
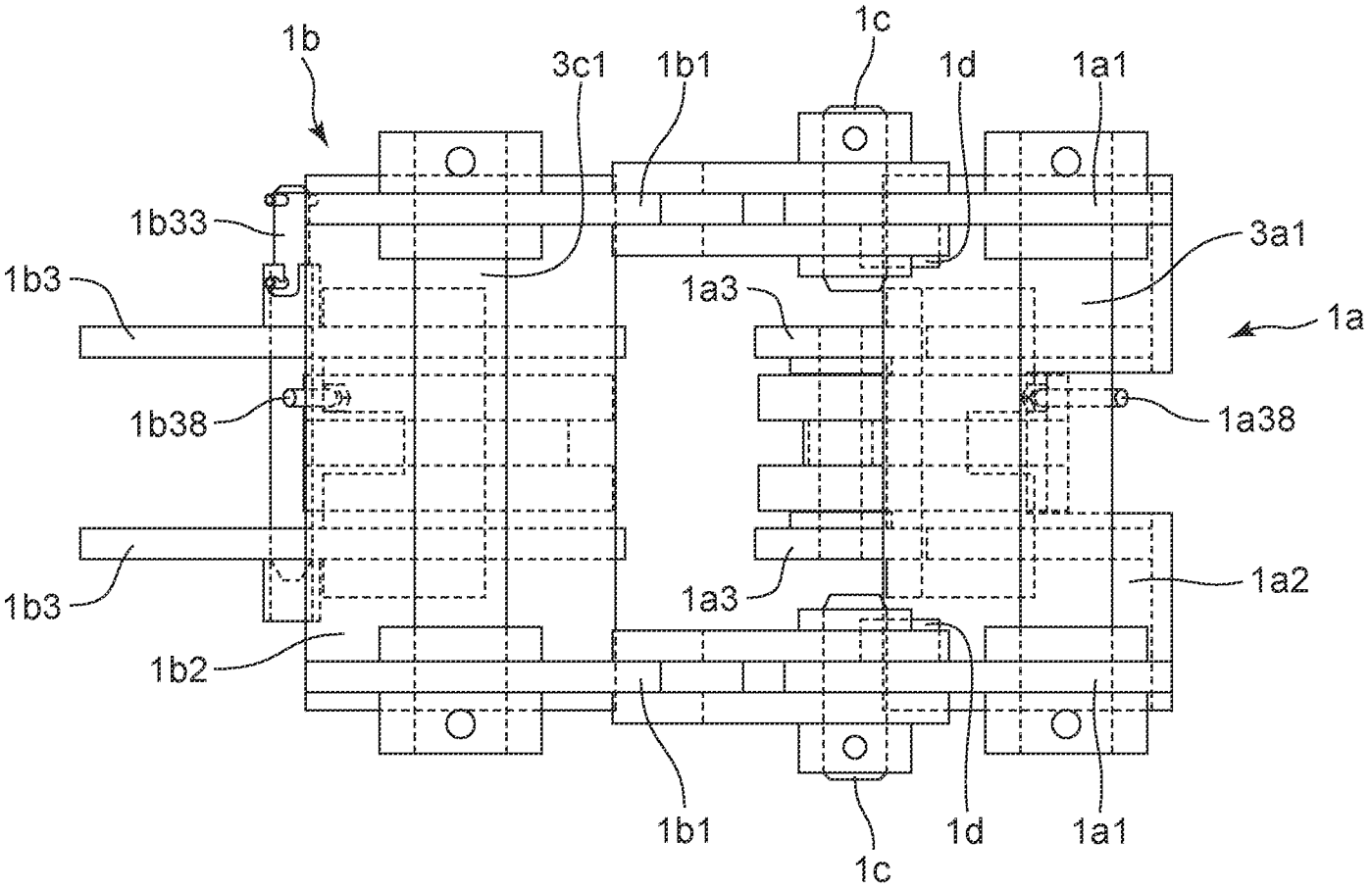
FIG. 2 is a plan view illustrating the attachment holder for construction equipment according to the embodiment.
Figure 3:
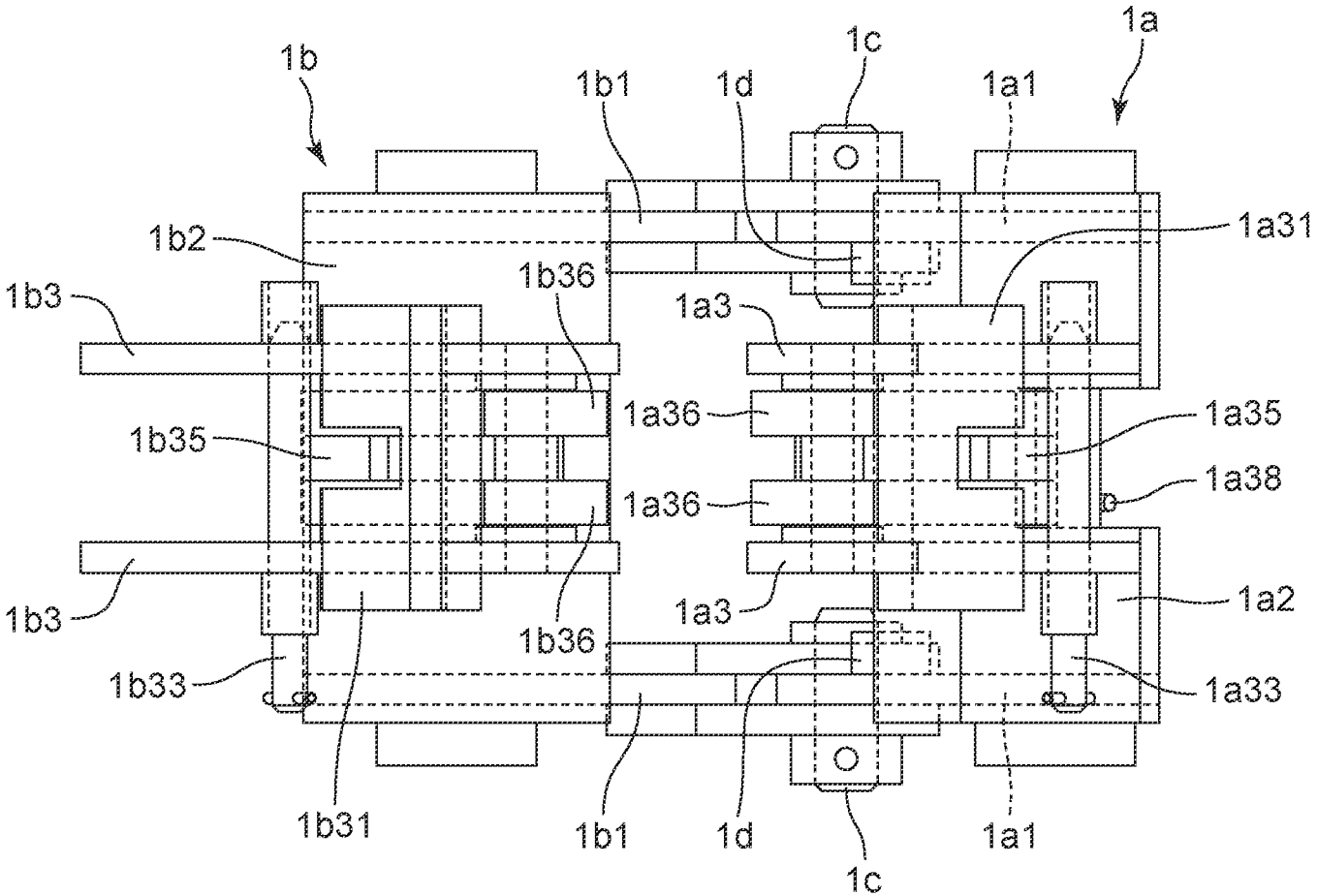
FIG. 3 is a bottom view illustrating the attachment holder for construction equipment according to the embodiment.
Figure 4:
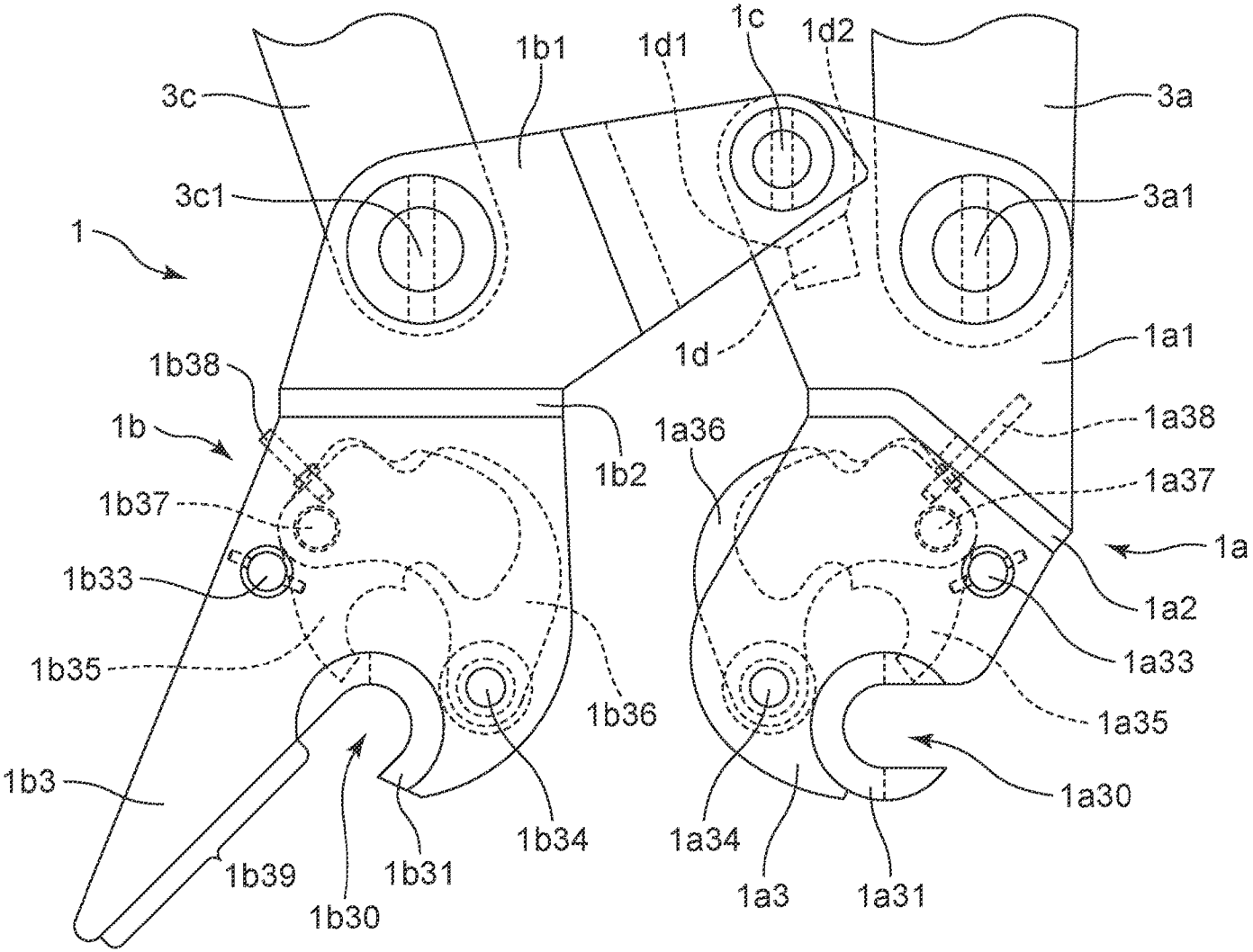
FIG. 4 is a front view illustrating the attachment holder for construction equipment according to the embodiment.
Figure 5:
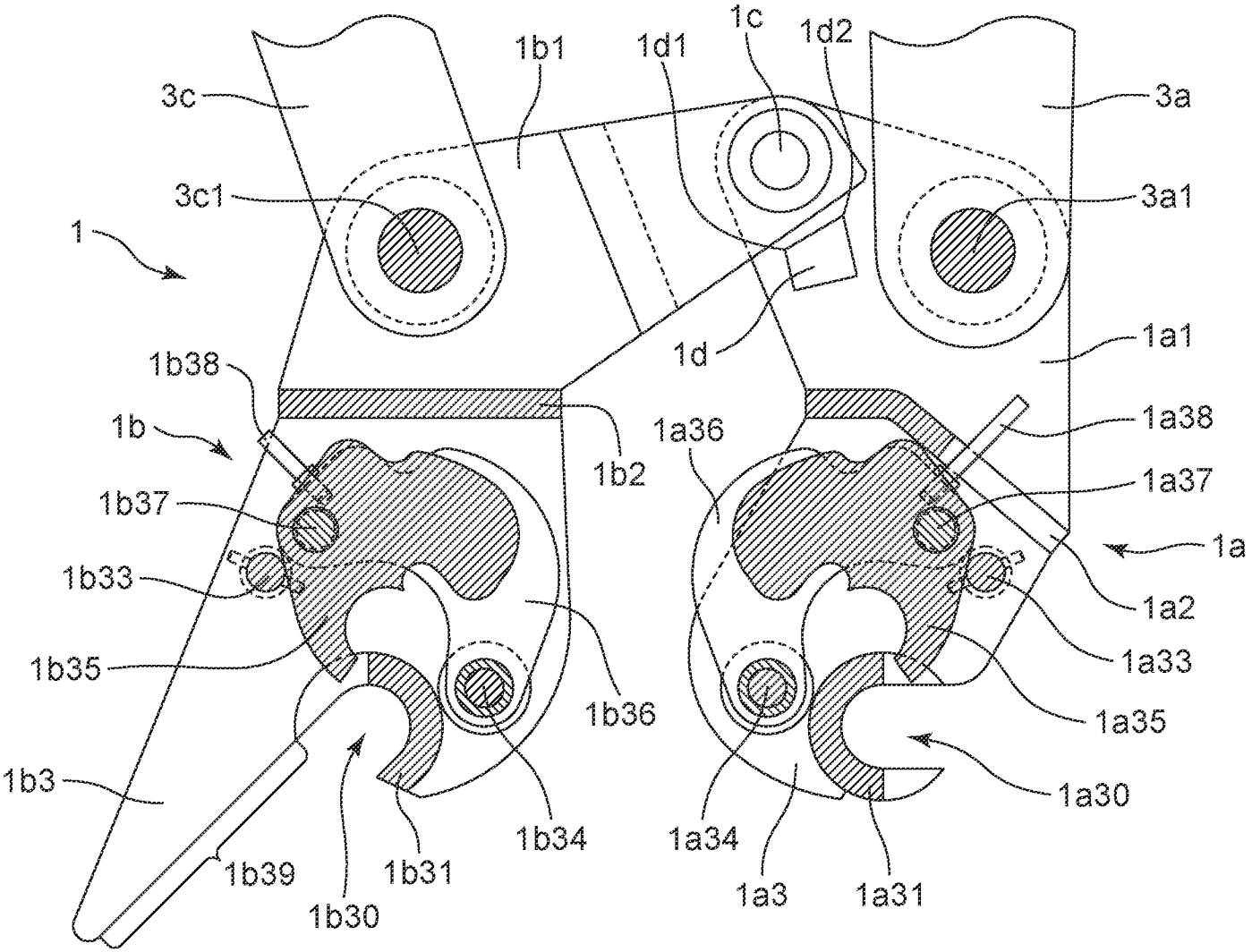
FIG. 5 is a cross-sectional view illustrating the attachment holder for construction equipment according to the embodiment.
Figure 6:
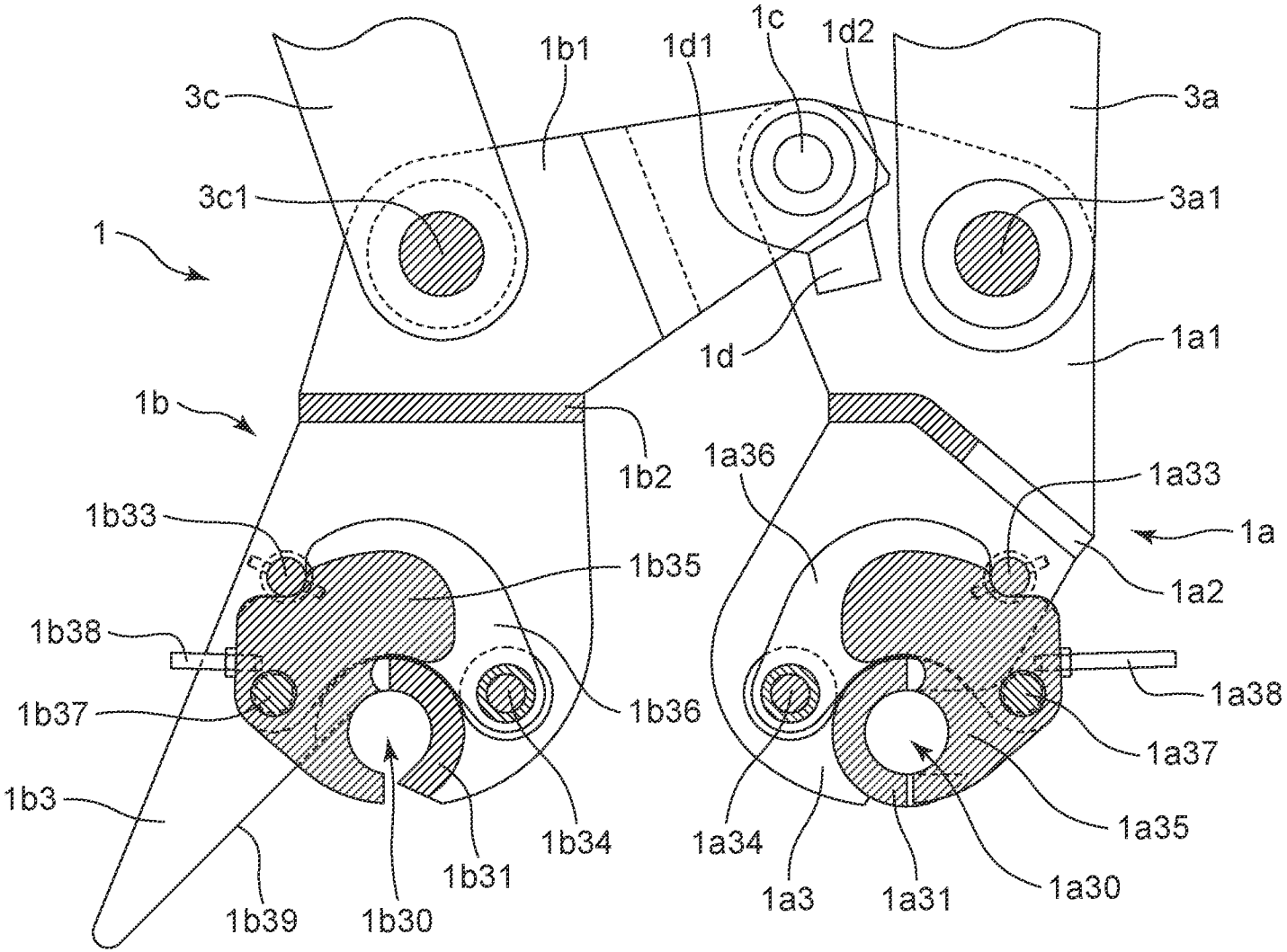
FIG. 6 is a cross-sectional view illustrating a state in which an opening of a stationary-side pin accommodation portion and an opening of a movable-side pin accommodation portion are closed respectively by a stationary-side closer portion and a movable-side closer portion in the attachment holder for construction equipment according to the embodiment.

Moreover, in the embodiment, as illustrated in FIGS. 2 to 4, the movable-side hook plate 1b3 includes a movable-side pin guidance surface 1b39 that is disposed outside the opening of the movable-side pin accommodation portion 1b30 of the movable-side jaw 1b. The movable-side pin guidance surface 1b39 comes into contact with the movable-side coupling pin 2b and guides the movable-side coupling pin 2b until the movable-side coupling pin 2b is accommodated in the movable-side pin accommodation portion 1b30 whether an attachment to be attached to a construction machine has a minimum pin-to-pin spacing between the stationary-side coupling pin 2a and the movable-side coupling pin 2b or a maximum pin-to-pin spacing.

The length of the movable-side pin guidance surface 1b39 is provided such that the movable-side coupling pin 2b can come into contact with the movable-side pin guidance surface 1b39 when an attachment is attached even if the attachment to be attached to a construction machine has a minimum pin-to-pin spacing between the stationary-side coupling pin 2a and the movable-side coupling pin 2b or has a maximum pin-to-pin spacing, which will be described below.

Method of Mounting Attachment by Using Attachment Holder 1 for Construction Equipment Next, among attachments to be used for a construction machine, cases of attaching a bucket 2' with the minimum pin-to-pin spacing and a crusher 2" with the maximum pin-to-pin spacing by using the above-configured attachment holder 1 for construction equipment will be described. For example, the pin-to-pin spacing of the bucket 2' between the stationary-side coupling pin 2a and the movable-side coupling pin 2b is approximately 320 mm, and the pin-to-pin spacing of the crusher 2" is approximately 580 mm.

Case of Mounting Bucket 2' with Minimum Pin-to-Pin Spacing

Figure 9:
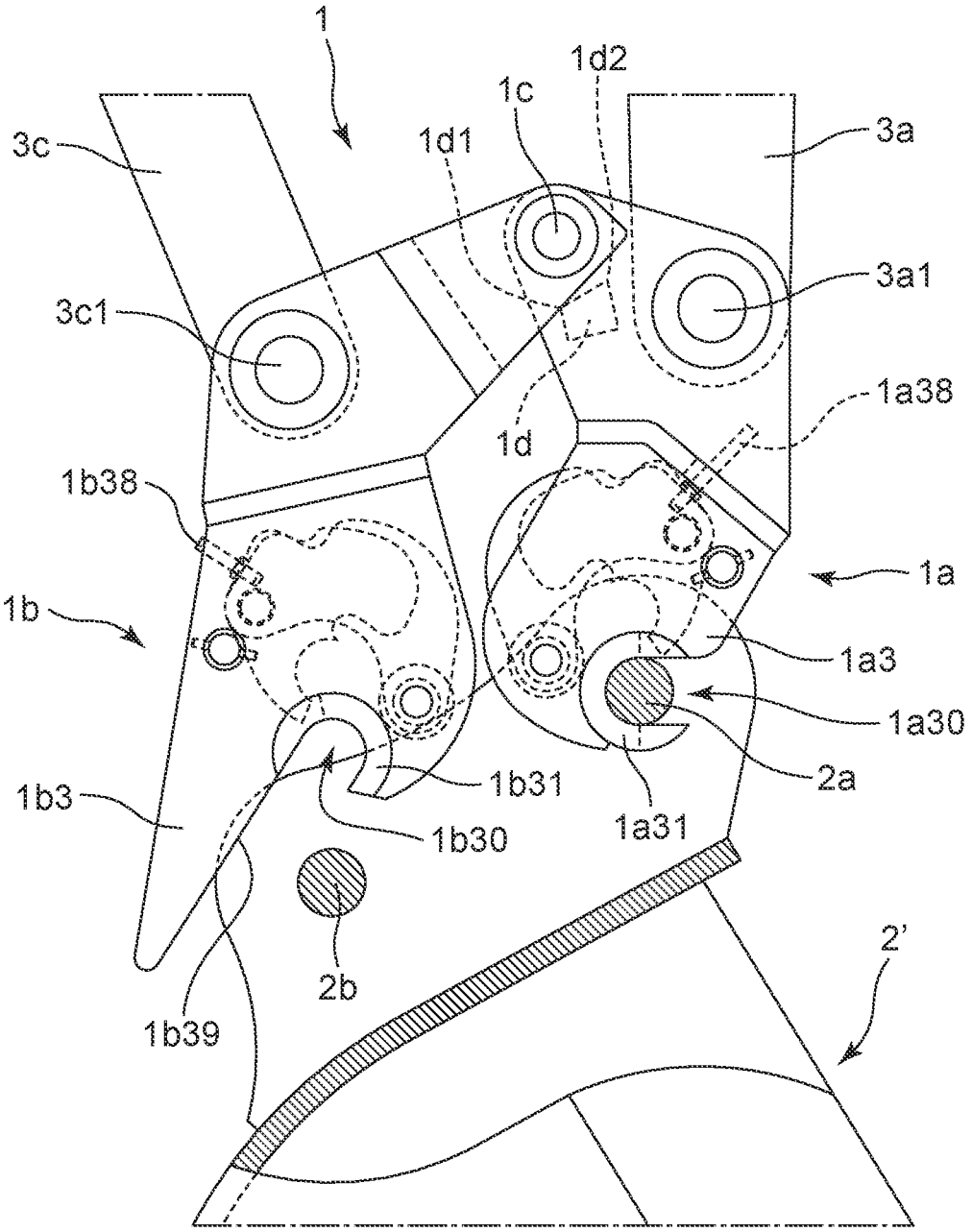
FIG. 9 is a front view illustrating a state in which a stationary-side coupling pin of an attachment (such as a bucket) having a small pin-to-pin spacing is accommodated in the stationary-side pin accommodation portion of the stationary-side jaw in the attachment holder for construction equipment according to the embodiment.

First, an operator actuates the bucket cylinder 3b of a construction machine so as to extend the piston 3b1 (see FIG. 1). As illustrated in FIG. 9, the movable-side jaw 1b is thereby closed with respect to the stationary-side jaw 1a, and the bottom portion of the movable-side link plate 1b1 of the movable-side jaw 1b near the pivot shaft 1c is brought into contact with the excessive closure prevention portion 1d1 of the stopper 1d. In this state, the operator actuates, for example, an arm cylinder (not illustrated) and a boom cylinder (not illustrated) and thereby moves the arm 3a and the attachment holder 1 closer to the bucket 2' and causes the semicircular engaging portion 1a31 of the stationary-side hook plate 1a3 of the stationary-side jaw 1a to engage the stationary-side coupling pin 2a of the bucket 2'. The stationary-side coupling pin 2a is consequently accommodated in the stationary-side pin accommodation portion 1a30.

Next, in the state of the stationary-side pin accommodation portion 1a30 engaging the stationary-side coupling pin 2a of the bucket 2', the operator actuates, for example, the arm cylinder (not illustrated) and the boom cylinder (not illustrated) and lowers the movable-side jaw 1b while lifting the bucket 2' or swinging the entire arm 3a with the excessive closure prevention portion 1d1 of the stopper 1d being in contact with the bottom portion of the movable-side link plate 1b1 of the movable-side jaw 1b near the pivot shaft 1c.

Figure 10:
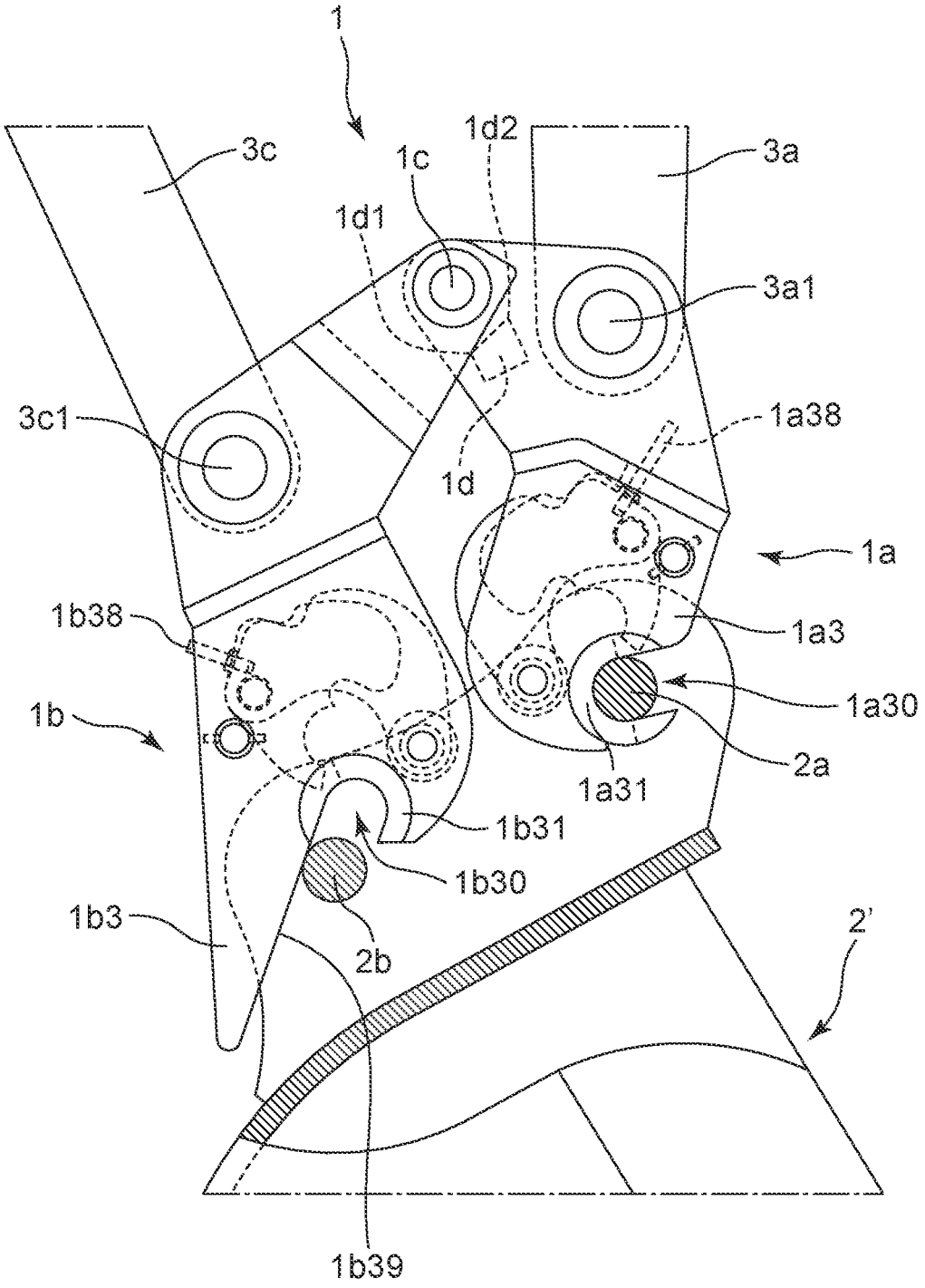
FIG. 10 is a front view illustrating a state in which after the stationary-side coupling pin of the attachment (such as a bucket) having a small pin-to-pin spacing is accommodated in the stationary-side pin accommodation portion of the stationary-side jaw in the attachment holder for construction equipment according to the embodiment, the movable-side jaw is moved closer to a movable-side coupling pin by actuating a bucket cylinder, and a movable-side pin guidance surface of the movable-side jaw is thereby brought into contact with a movable-side coupling pin.

In the attachment holder 1 for construction equipment according to the embodiment, as illustrated in FIG. 10, the movable-side coupling pin 2b of the bucket 2' comes into contact with a base portion (i.e., a portion near the movable-side pin accommodation portion 1b30) of the movable-side pin guidance surface 1b39 of the movable-side jaw 1b.

Next, the operator opens the movable-side jaw 1b with respect to the stationary-side jaw 1a by actuating the bucket cylinder 3b of the construction machine so as to retract the piston 3b1 (see FIG. 1). As a result, the bottom portion of the movable-side link plate 1b1 of the movable-side jaw 1b near the pivot shaft 1c is separated from the excessive closure prevention portion 1d1 of the stopper 1d.

Figure 11:
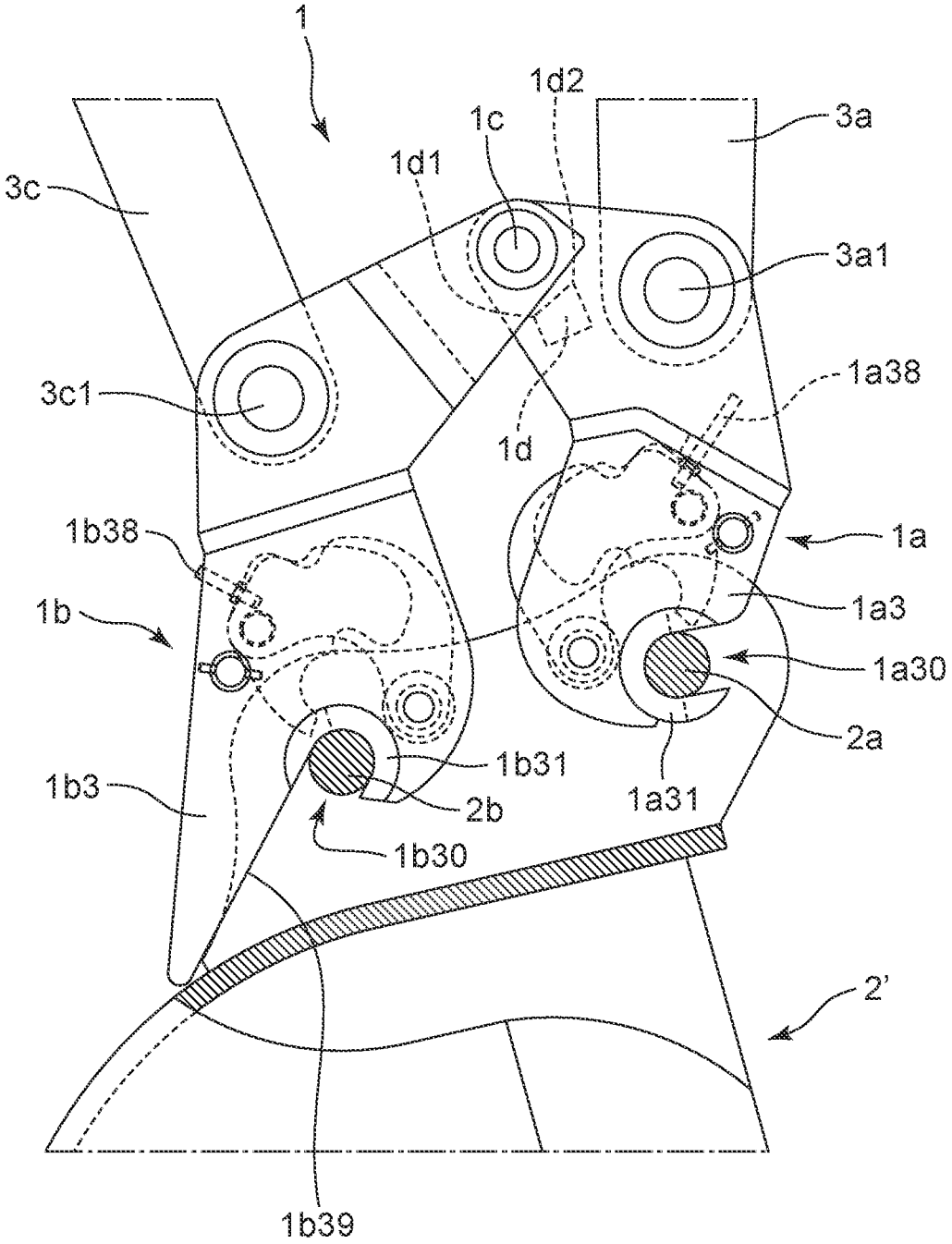
FIG. 11 is a front view illustrating a state in which after the stationary-side coupling pin of the attachment (such as a bucket) having a small pin-to-pin spacing is accommodated in the stationary-side pin accommodation portion of the stationary-side jaw in the attachment holder for construction equipment according to the embodiment, the movable-side pin guidance surface of the movable-side jaw is brought into contact with the movable-side coupling pin by actuating the bucket cylinder, and the movable-side coupling pin is accommodated in the movable-side pin accommodation portion of the movable-side jaw.

Subsequently, in the case in which the bucket 2' having a minimum pin-to-pin spacing is to be mounted on the attachment holder 1 for construction equipment, the movable-side jaw 1b opens with respect to the stationary-side jaw 1a while the movable-side coupling pin 2b of the bucket 2' being in contact with the movable-side pin guidance surface 1b39. Consequently, as illustrated in FIG. 11, the movable-side coupling pin 2b is accommodated in the movable-side pin accommodation portion 1b30 of the movable-side jaw 1b.

Thus, the movable-side coupling pin 2b of the bucket 2' is accommodated in the movable-side pin accommodation portion 1b30 of the movable-side jaw 1b while the stationary-side coupling pin 2a of the bucket 2' is accommodated in the stationary-side pin accommodation portion 1a30 of the stationary-side jaw 1a.

Next, as is similar to the case described in Japanese Patent No. 6211324, the operator pulls out the locking pin 1a33 and the locking pin 1b33 from the respective locking pin holes 1a32 and 1b32 of the stationary-side hook plate 1a3 and the movable-side hook plate 1b3. The operator manually rotates the first semicircular pivotal closer members 1a35 and 1b35 and the second semicircular pivotal closer members 1a36 and 1b36 about the respective pivot shafts 1a34 and 1b34 of the stationary-side jaw 1a and the movable-side jaw 1b by turning the handle 1a38 of the stationary-side jaw 1a clockwise in FIG. 9 and also by turning the handle 1b38 of the movable-side jaw 1b counterclockwise in FIG. 9. Consequently, as illustrated in FIG. 12, the opening of the semicircular engaging portion 1a31 and the opening of the semicircular engaging portion 1b31 are closed.

Figure 12:
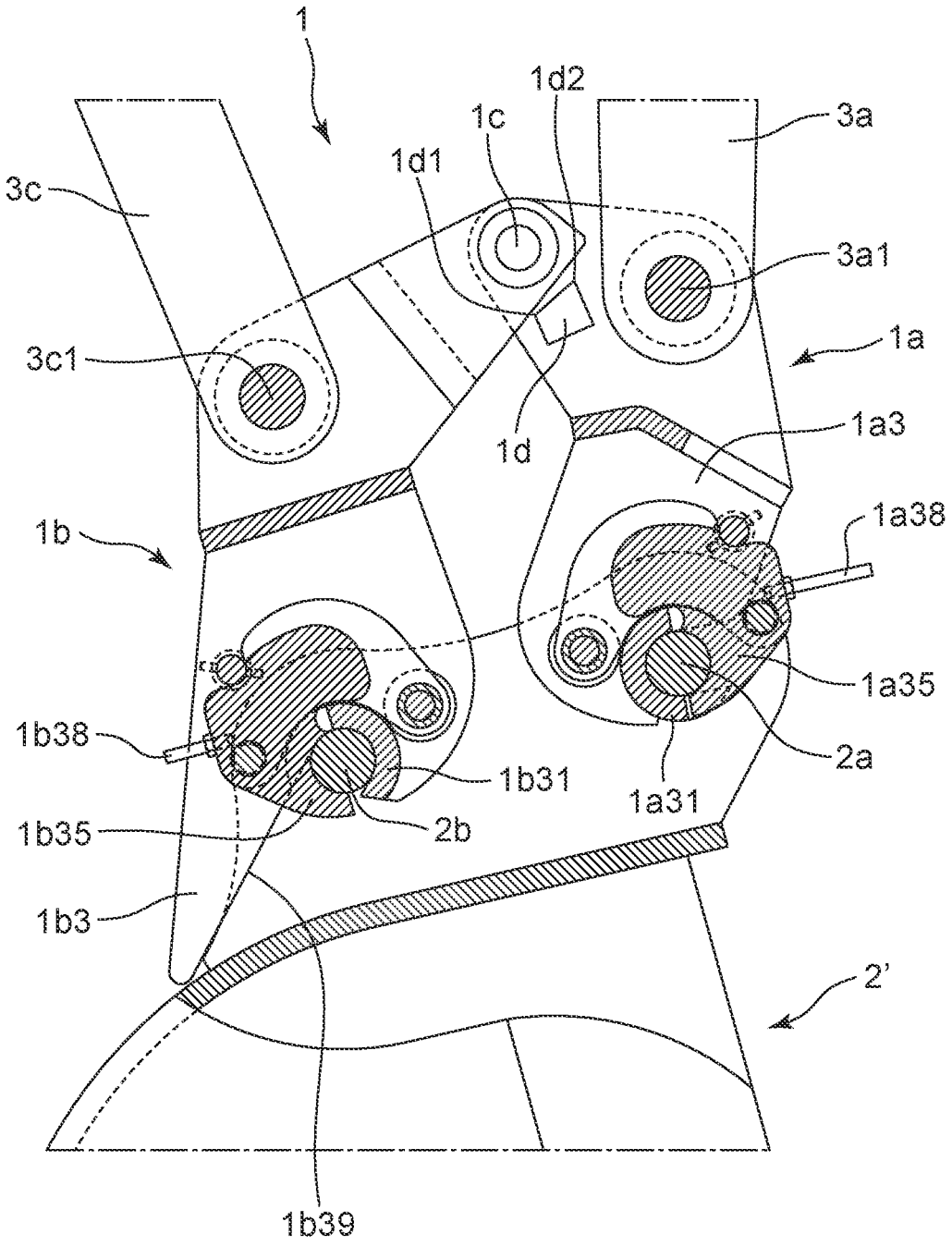
FIG. 12 is a cross-sectional view illustrating a state in which after the stationary-side coupling pin of the attachment (such as a bucket) having a small pin-to-pin spacing is accommodated in the stationary-side pin accommodation portion of the stationary-side jaw in the attachment holder for construction equipment according to the embodiment and the movable-side coupling pin is accommodated in the movable-side pin accommodation portion of the movable-side jaw by actuating the bucket cylinder, the stationary-side pin accommodation portion and the movable-side pin accommodation portion are closed respectively by the stationary-side closer portion and the movable-side closer portion.

Lastly, as illustrated in FIG. 12, the operator inserts the locking pin 1a33 and the locking pin 1b33 into the respective locking pin holes 1a32 and 1b32 of the stationary-side hook plate 1a3 and the movable-side hook plate 1b3 and thereby locks the first semicircular pivotal closer members 1a35 and 1b35 and the second semicircular pivotal closer members 1a36 and 1b36 so as to prevent rotation. This can maintain the state in which the stationary-side coupling pin 2a and the movable-side coupling pin 2b is securely held by the first and second semicircular pivotal closer members 1a35, 1b35, 1a36, and 1b36.

By using the attachment holder 1 for construction equipment according to the embodiment, the bucket 2' can be securely mounted on and used by the construction machine even in the case in which the attachment holder is not equipped with a regulation mechanism of the known art, such as a screw mechanism or a hydraulic cylinder 3b that regulates opening operation or the opening angle of the movable-side jaw 1b with respect to the stationary-side jaw 1a.

Case of Mounting Crusher 2" with Maximum Pin-to-Pin Spacing

Figure 13:
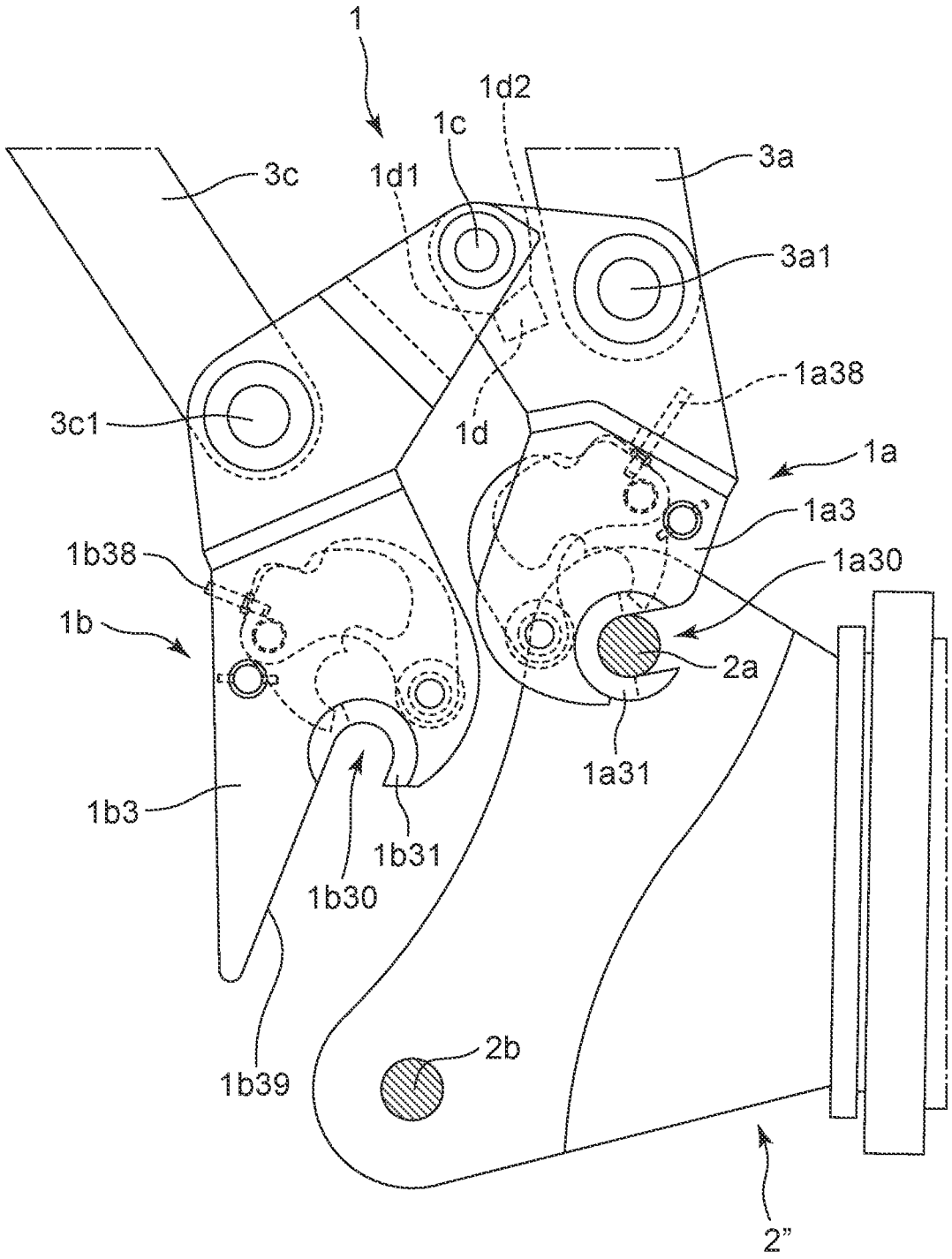
FIG. 13 is a front view illustrating a state in which a stationary-side coupling pin of an attachment (such as a crusher) having a large pin-to-pin spacing is accommodated in the stationary-side pin accommodation portion of the stationary-side jaw in the attachment holder for construction equipment according to the embodiment.

In the case of mounting the crusher 2" with the maximum pin-to-pin spacing, an operator first actuates the bucket cylinder 3*b* of a construction machine so as to extend the piston 3*b*1 (see FIG. 1) and moves the attachment holder 1 of the embodiment closer to the crusher 2". As illustrated in FIG. 13, which is similar to the case illustrated in FIG. 9, the movable-side jaw 1*b* is thereby closed with respect to the stationary-side jaw 1*a*, and the bottom portion of the movable-side link plate 1*b*1 of the movable-side jaw 1*b* near the pivot shaft 1*c* is brought into contact with the excessive closure prevention portion 1*d*1 of the stopper 1*d*. In this state, the operator actuates, for example, an arm cylinder (not illustrated) and a boom cylinder (not illustrated) and thereby moves the arm 3*a* and the attachment holder 1 closer to the crusher 2" and causes the semicircular engaging portion 1*a*31 of the stationary-side hook plate 1*a*3 of the stationary-side jaw 1*a* to engage the stationary-side coupling pin 2*a* of the crusher 2". The stationary-side coupling pin 2*a* is consequently accommodated in the stationary-side pin accommodation portion 1*a*30.

Next, in the state of the stationary-side pin accommodation portion 1*a*30 engaging the stationary-side coupling pin 2*a* of the crusher 2", the operator actuates, for example, the arm cylinder (not illustrated) and the boom cylinder (not illustrated) and lowers the movable-side jaw 1*b* while lifting the crusher 2" or swinging the entire arm 3*a* with the excessive closure prevention portion 1*d*1 of the stopper 1*d* being in contact with the bottom portion of the movable-side link plate 1*b*1 of the movable-side jaw 1*b* near the pivot shaft 1*c*.

Figure 14:
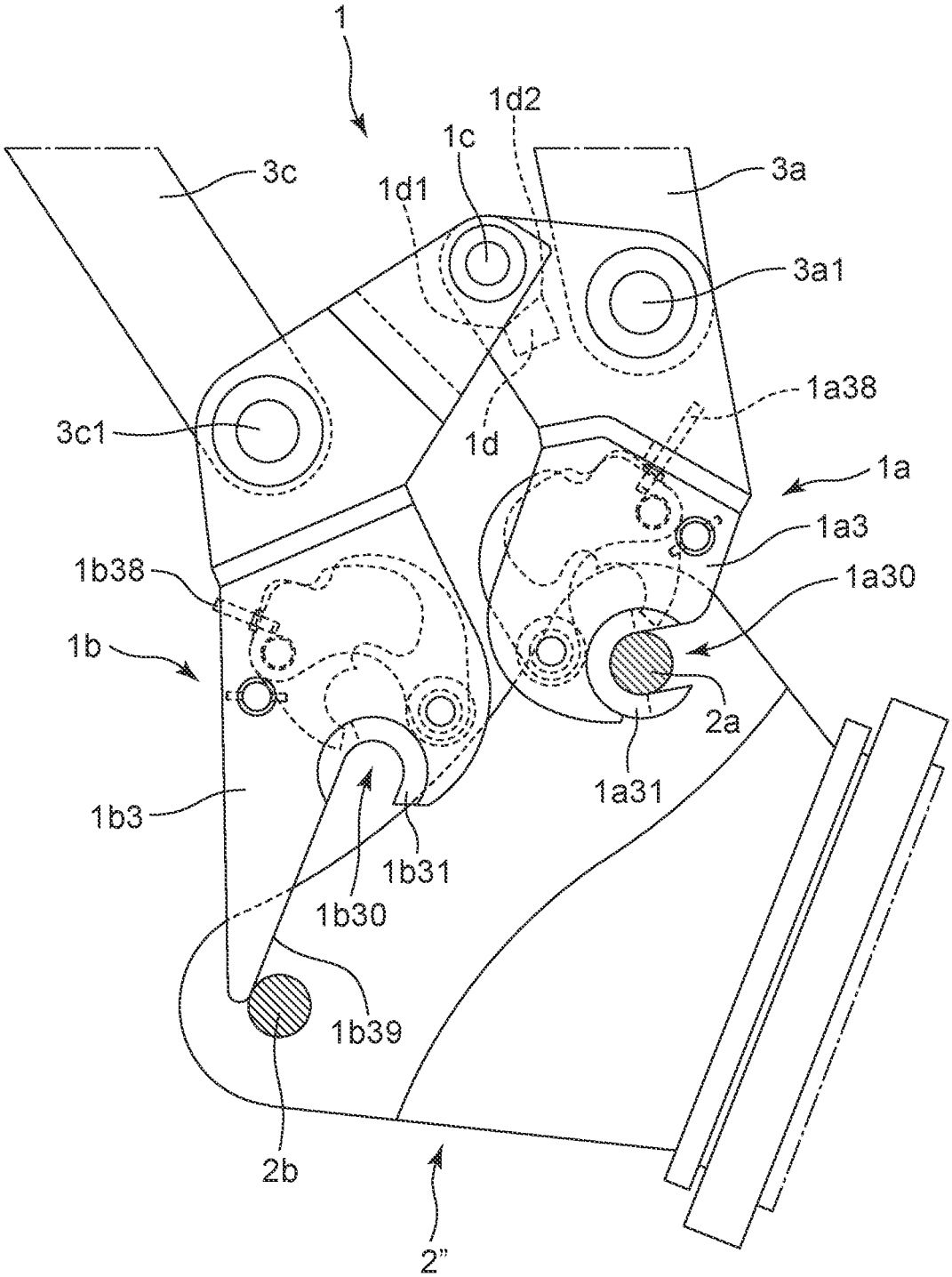
FIG. 14 is a front view illustrating a state in which after the stationary-side coupling pin of the attachment (such as a crusher) having a large pin-to-pin spacing is accommodated in the stationary-side pin accommodation portion of the stationary-side jaw in the attachment holder for construction equipment according to the embodiment, the movable-side jaw is moved closer to a movable-side coupling pin by actuating a bucket cylinder and a movable-side pin guidance surface of the movable-side jaw is brought into contact with a movable-side coupling pin.

As illustrated in FIG. 14, in the case in which the crusher 2" having the maximum pin-to-pin spacing is to be mounted on the attachment holder 1 for construction equipment according to the embodiment, the movable-side coupling pin 2*b* of the crusher 2" comes into contact with an end portion (i.e., a portion distant from the movable-side pin accommodation portion 1*b*30) of the movable-side pin guidance surface 1*b*39 of the movable-side jaw 1*b*.

Next, the operator opens the movable-side jaw 1*b* with respect to the stationary-side jaw 1*a* by actuating the bucket cylinder 3*b* of the construction machine so as to retract the piston 3*b*1 (see FIG. 1). As a result, the bottom portion of the movable-side link plate 1*b*1 of the movable-side jaw 1*b* near the pivot shaft 1*c* is separated from the excessive closure prevention portion 1*d*1 of the stopper 1*d*.

Figure 15:
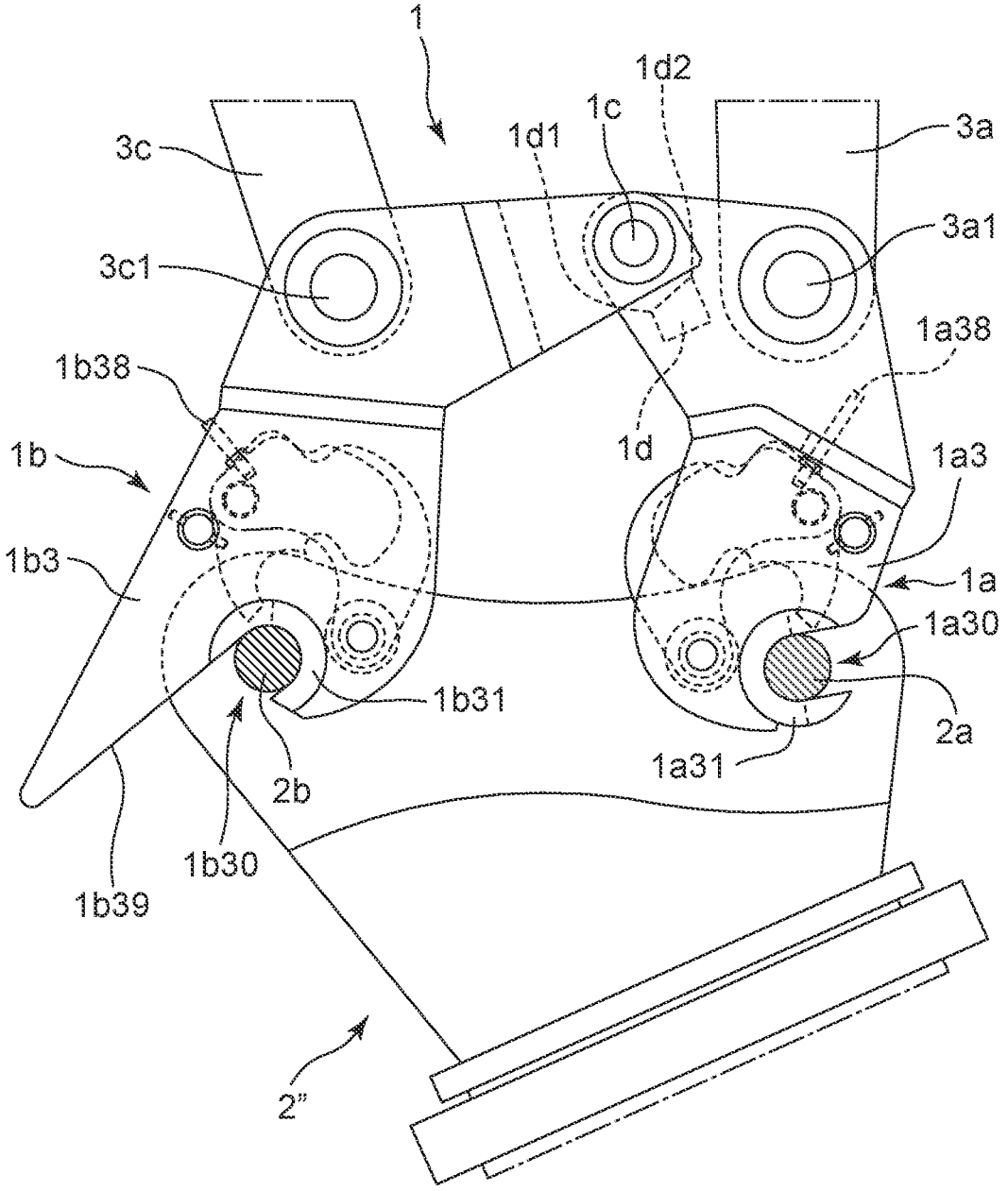
FIG. 15 is a front view illustrating a state in which after the stationary-side coupling pin of the attachment (such as a crusher) having a large pin-to-pin spacing is accommodated in the stationary-side pin accommodation portion of the stationary-side jaw in the attachment holder for construction equipment according to the embodiment, the movable-side pin guidance surface of the movable-side jaw is brought into contact with the movable-side coupling pin by actuating the bucket cylinder and the movable-side coupling pin is accommodated in the movable-side pin accommodation portion of the movable-side jaw.

Subsequently, in the attachment holder 1 for construction equipment according to the embodiment, the movable-side jaw 1*b* opens with respect to the stationary-side jaw 1*a* while the movable-side coupling pin 2*b* of the crusher 2" being in contact with the movable-side pin guidance surface 1*b*39. Consequently, as illustrated in FIG. 15, the movable-side coupling pin 2*b* is accommodated in the movable-side pin accommodation portion 1*b*30 of the movable-side jaw 1*b*.

Thus, the movable-side coupling pin 2*b* of the crusher 2" is accommodated in the movable-side pin accommodation portion 1*b*30 of the movable-side jaw 1*b* while the stationary-side coupling pin 2*a* of the crusher 2" is accommodated in the stationary-side pin accommodation portion 1*a*30 of the stationary-side jaw 1*a*.

Next, as is similar to the case described in Japanese Patent No. 6211324, the operator pulls out the locking pin 1*a*33 and the locking pin 1*b*33 from the respective locking pin holes 1*a*32 and 1*b*32 of the stationary-side hook plate 1*a*3 and the movable-side hook plate 1*b*3. The operator manually rotates the first semicircular pivotal closer members 1*a*35 and 1*b*35 and the second semicircular pivotal closer members 1*a*36 and 1*b*36 about the respective pivot shafts 1*a*34 and 1*b*34 of the stationary-side jaw 1*a* and the movable-side jaw 1*b* by turning the handle 1*a*38 of the stationary-side jaw 1*a* clockwise in FIG. 9 and also by turning the handle 1*b*38 of the movable-side jaw 1*b* counterclockwise in FIG. 9. Consequently, as illustrated in FIG. 16, the opening of the semicircular engaging portion 1*a*31 and the opening of the semicircular engaging portion 1*b*31 are closed.

Figure 16:
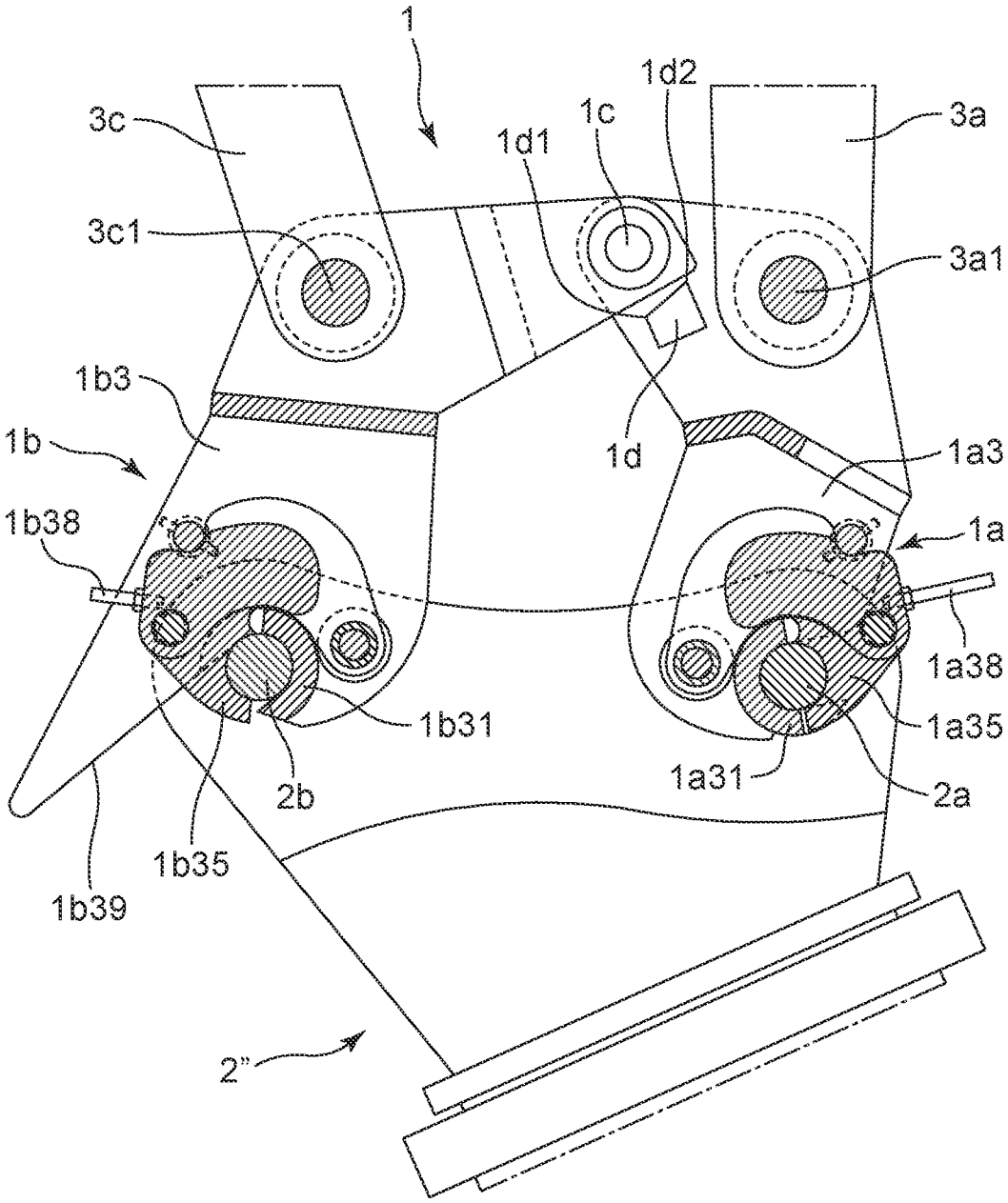
FIG. 16 is a cross-sectional view illustrating a state in which after the stationary-side coupling pin of the attachment (such as a crusher) having a large pin-to-pin spacing is accommodated in the stationary-side pin accommodation portion of the stationary-side jaw in the attachment holder for construction equipment according to the embodiment and the movable-side coupling pin is accommodated in the movable-side pin accommodation portion of the movable-side jaw by actuating the bucket cylinder, the stationary-side pin accommodation portion and the movable-side pin accommodation portion are closed respectively by the stationary-side closer portion and the movable-side closer portion.

Lastly, as illustrated in FIG. 16, the operator inserts the locking pin 1*a*33 and the locking pin 1*b*33 into the respective locking pin holes 1*a*32 and 1*b*32 of the stationary-side hook plate 1*a*3 and the movable-side hook plate 1*b*3 and thereby locks the first and second semicircular pivotal closer members 1*a*35 and 1*a*36 of the stationary-side jaw 1*a* and the first and second semicircular pivotal closer members 1*b*35 and 1*b*36 of the movable-side jaw 1*b*. This can maintain the state in which the stationary-side coupling pin 2*a* and the movable-side coupling pin 2*b* is securely held by the first and second semicircular pivotal closer members 1*a*35, 1*b*35, 1*a*36, and 1*b*36 of the stationary-side jaw 1*a* and the movable-side jaw 1*b*.

By using the attachment holder 1 for construction equipment according to the embodiment, the crusher 2" with the maximum pin-to-pin spacing can be securely mounted on and used by the construction machine even in the case in which the attachment holder is not equipped with a regulation mechanism of the known art, such as a screw mechanism or a hydraulic cylinder 3*b*, that regulates opening operation or the opening angle of the movable-side jaw 1*b* with respect to the stationary-side jaw 1*a*.

Thus, whether the attachment is the bucket 2' having the minimum pin-to-pin spacing between the stationary-side coupling pin 2*a* and the movable-side coupling pin 2*b* or is the crusher 2" having the maximum pin-to-pin spacing, the attachment can be securely mounted on and used by the construction machine by using the attachment holder 1 for construction equipment according to the embodiment even in the case in which the attachment holder is not equipped with the regulation mechanism of the known art, such as the screw mechanism or the hydraulic cylinder 3*b*, that regulates opening operation or the opening angle of the movable-side jaw 1*b* with respect to the stationary-side jaw 1.

Advantageous Effects of Attachment Holder 1 for Construction Equipment

As described above, the attachment holder 1 for construction equipment according to the embodiment includes the movable-side pin guidance surface 1*b*39 that is disposed outside the opening of the movable-side pin accommodation portion 1*b*30 of the movable-side jaw 1*b* and that comes into contact with the movable-side coupling pin 2*b* and guides the movable-side coupling pin 2*b* until the movable-side coupling pin 2*b* is accommodated in the movable-side pin accommodation portion 1*b*30. The attachment holder 1 also includes the excessive closure prevention portion 1*d*1 of the stopper 1*d* that prevents the movable-side jaw 1*b* from closing excessively with respect to the stationary-side jaw 1*a* to enable the movable-side coupling pin 2*b* to come into contact with the movable-side pin guidance surface 1*b*39, whether the movable-side coupling pin 2*b* is a movable-side coupling pin of an attachment for construction equipment that has a minimum pin-to-pin spacing between the stationary-side coupling pin 2*a* and the movable-side coupling pin 2*b* or a maximum pin-to-pin spacing, in a case in which the movable-side coupling pin 2*b* is to be accommodated in the movable-side pin accommodation portion 1*b*30 of the movable-side jaw 1*b* by actuating a hydraulic cylinder or the like disposed in the arm 3*a* of the construction machine so as to move the movable-side jaw 1*b* closer to the movable-side coupling pin 2*b* after the stationary-side coupling pin 2*a* is accommodated in the stationary-side pin accommodation portion 1*a*30 of the stationary-side jaw 1*a*.

Accordingly, the attachment holder 1 for construction equipment according to the embodiment does not require the regulation mechanism, such as the screw mechanism or the hydraulic cylinder 3*b*, that regulates opening operation and the opening angle of the movable-side jaw 1*b* with respect to the stationary-side jaw 1*a*. This leads to cost reduction. The coupling pins can be accommodated in the respective pin accommodation portions of the stationary-side jaw 1*a* and the movable-side jaw 1*b* and can be prevented from being detached from the stationary-side jaw 1*a* and the movable-side jaw 1*b*.

In addition, in the attachment holder 1 for construction equipment according to the embodiment, the stationary-side jaw 1*a* and the movable-side jaw 1*b* are configured to pivotally move about the pivot shaft 1*c*, and the excessive opening prevention portion 1*d*2 is disposed in the stopper 1*d* to prevent the movable-side jaw 1*b* from excessively opening pivotally about the pivot shaft 1*c* with respect to the stationary-side jaw 1*a*.

Accordingly, the attachment holder 1 for construction equipment according to the embodiment can prevent the movable-side jaw 1*b* from opening excessively with respect to the stationary-side jaw 1*a* even if the attachment holder 1 does not include the regulation mechanism, such as a screw mechanism or a hydraulic cylinder 3*b*, that regulates opening operation or the opening angle of the movable-side jaw 1*b* with respect to the stationary-side jaw 1*a*. This leads to a reduction in cost and to an improvement in workability in mounting the attachment.

In the above-described embodiment, the corner portions of the single stopper 1*d* disposed on the stationary-side link plate 1*a*1 of the stationary-side jaw 1*a* function as the excessive closure prevention portion 1*d*1 and the excessive opening prevention portion 1*d*2. However, as illustrated in FIGS. 17A and 17B by way of example, the excessive closure prevention portion 1*d*1 and the excessive opening prevention portion 1*d*2 may be provided independently of each other on the stationary-side link plate 1*a*1 of the stationary-side jaw 1*a* to prevent the movable-side jaw 1*b* from opening or closing pivotally about the pivot shaft 1*c* excessively with respect to the stationary-side jaw 1*a*.

Figure 17A:
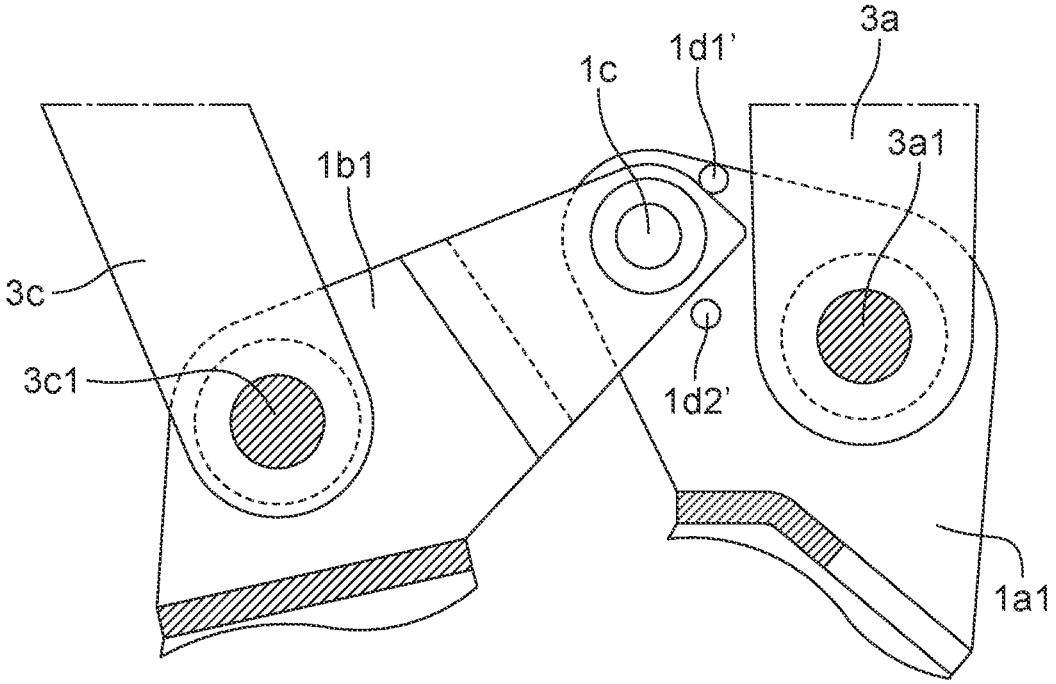
FIG. 17A is a partial cross-sectional view illustrating a state in which another excessive closure prevention portion that constitutes the attachment holder for construction equipment according to the embodiment is disposed independently and prevents the movable-side jaw from closing excessively.
Figure 17B:
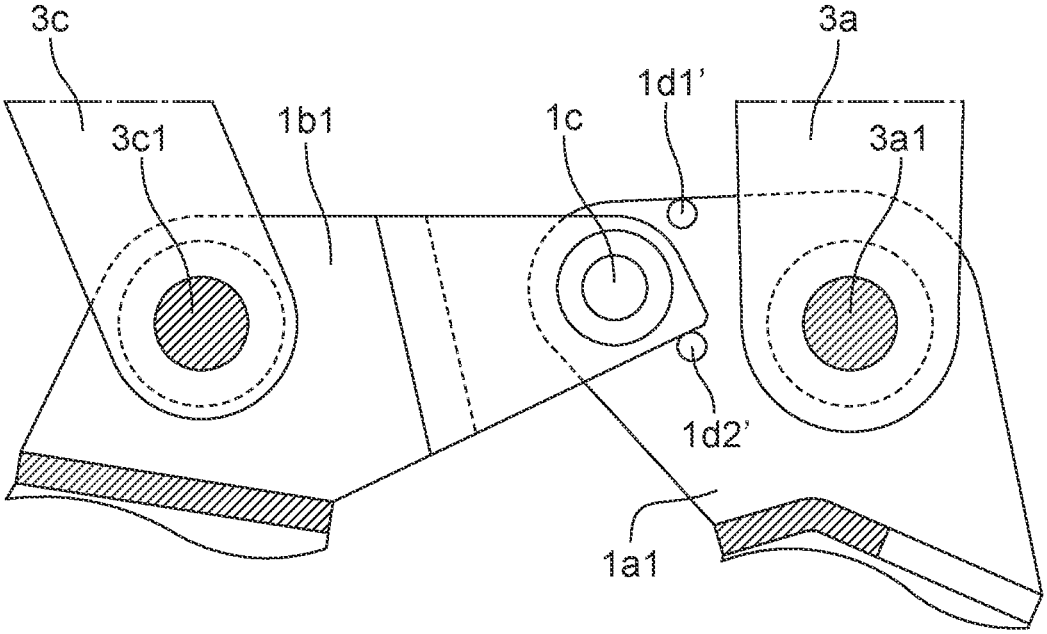
FIG. 17B is a partial cross-sectional view illustrating a state in which another excessive opening prevention portion that constitutes the attachment holder for construction equipment according to the embodiment is disposed independently and prevents the movable-side jaw from opening excessively.
Figure 18:
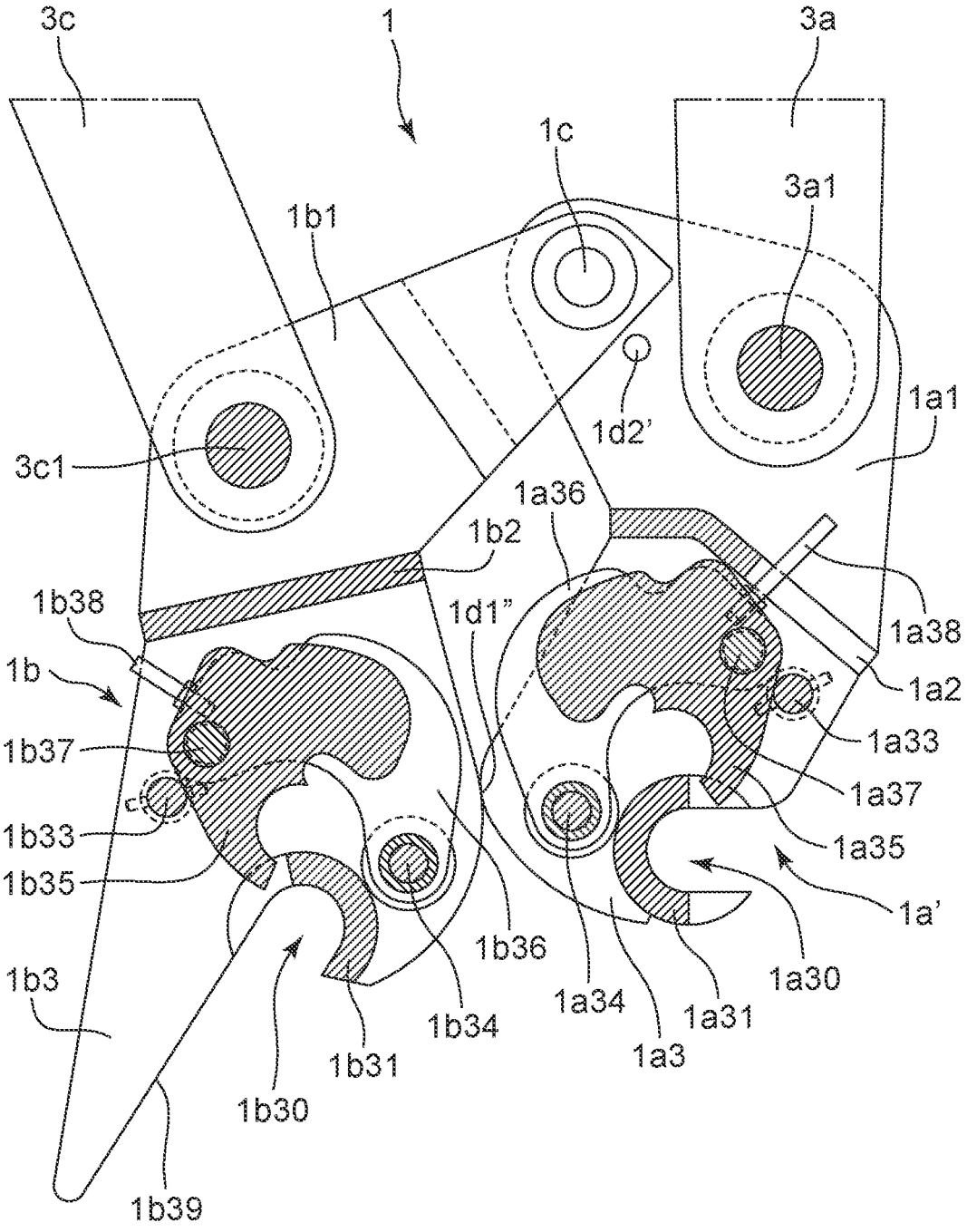
FIG. 18 is a partial cross-sectional view illustrating the attachment holder for construction equipment according to the embodiment, in which another excessive opening prevention portion that constitutes the attachment holder is disposed and respective middle portions of the stationary-side jaw and the movable-side jaw function as an excessive closure prevention portion.

Alternatively, as illustrated in FIG. 18, the excessive opening prevention portion 1*d*2' may be disposed on the stationary-side link plate 1*a*1 of the stationary-side jaw 1*a*, as is the case illustrated in FIGS. 17A and 17B, while an excessive closure prevention portion 1*d*1" may be formed, for example, as a projection of the stationary-side hook plate 1*a*3 of the stationary-side jaw 1*a* that is disposed at a position opposing the movable-side hook plate 1*b*3 of the movable-side jaw 1*b*. As illustrated in FIG. 18, the excessive closure prevention portion 1*d*1" of the stationary-side hook plate 1*a*3 of the stationary-side jaw 1*a*, which is the projection opposing the movable-side hook plate 1*b*3 of the movable-side jaw 1*b*, may come into contact with the movable-side hook plate 1*b*3 of the movable-side jaw 1*b*, and the movable-side pin guidance surface 1*b*39 comes into contact with the movable-side coupling pin 2*b*, whether the movable-side coupling pin is a movable-side coupling pin of an attachment for construction equipment that has a minimum pin-to-pin spacing between the stationary-side coupling pin and the movable-side coupling pin or a maximum pin-to-pin spacing, in a case in which the movable-side coupling pin 2*b* is to be accommodated in the movable-side pin accommodation portion 1*b*30, which is the inside of the semicircular engaging portion 1*b*31 of the movable-side jaw 1*b*, by actuating the bucket cylinder 3*b* disposed in the arm 3*a* of the construction machine so as to move the movable-side jaw 1*b* closer to the movable-side coupling pin 2*b* after the stationary-side coupling pin 2*a* is accommodated in the stationary-side pin accommodation portion 1*a*30, which is the inside of the semicircular engaging portion 1*a*31 of the stationary-side jaw 1*a*. Alternatively, the excessive closure prevention portion 1*d*1" may be formed as a projection (not illustrated) of the movable-side hook plate 1*b*3 of the movable-side jaw 1*b* that is disposed at a position opposing the stationary-side hook plate 1*a*3 of the stationary-side jaw 1*a*.

In the above-described embodiment, the excessive closure prevention portion 1*d*1 and the excessive opening prevention portion 1*d*2 are disposed in the attachment holder 1. However, the excessive opening prevention portion 1*d*2 may be omitted in the case in which the bucket cylinder 3*b* of the arm 3*a*, the arm cylinder (not illustrated), the boom cylinder (not illustrated), or the like, of the construction machine can prevent the movable-side jaw 1*b* from excessively opening pivotally about the pivot shaft 1*c* with respect to the stationary-side jaw 1*a*.

In the above-described embodiment, the stationary-side closer portion that closes the stationary-side pin accommodation portion 1*a*30 is a two-piece device formed of the first semicircular pivotal closer member 1*a*35 and the second semicircular pivotal closer member 1*a*36, and the movable-side closer portion that closes the movable-side pin accommodation portion 1*b*30 is also a two-piece device formed of the first semicircular pivotal closer member 1*b*35 and the second semicircular pivotal closer member 1*b*36. However, the stationary-side closer portion and the movable-side closer portion are not limited to these forms. For example, the stationary-side closer portion and the movable-side closer portion may be formed as single piece members that rotate about respective pivot shafts and close the stationary-side pin accommodation portion 1*a*30 and the movable-side pin accommodation portion 1*b*30. Alternatively, the stationary-side pin accommodation portion 1*a*30 and the movable-side pin accommodation portion 1*b*30 may be closed in such a manner that, for example, closer cylinders, each having a semicircular cross section, rotate respectively along the inside surfaces of the stationary-side pin accommodation portion 1*a*30 and the movable-side pin accommodation portion 1*b*30 so as to close the stationary-side and the movable-side pin accommodation portions 1*a*30 and 1*b*30.

In the above-described embodiment, the stationary-side jaw 1*a* and the movable-side jaw 1*b* open and close by pivotally moving about the pivot shaft 1*c* with respect to each other. However, the invention may be applied to an attachment holder in which the stationary-side jaw 1*a* and the movable-side jaw 1*b* open and close so as to slide against each other, which is described, for example, in Japanese Patent No. 6211324.

What is claimed is:

1. An attachment holder for construction equipment for mounting an attachment on a construction machine such that a stationary-side coupling pin and a movable-side coupling pin that are disposed on the attachment with a predetermined spacing therebetween are accommodated respectively in a stationary-side pin accommodation portion of a stationary-side jaw that is configured to be joined to an end of an arm of the construction machine and in a movable-side pin accommodation portion of a movable-side jaw that is configured to be joined, via a movable-side jaw link, to an end of a piston configured to retractably extend from a bucket cylinder disposed in the arm of the construction machine, and subsequently an opening of the stationary-side pin accommodation portion and an opening of the movable-side pin accommodation portion are configured to be closed respectively by a stationary-side closer portion and by a movable-side closer portion, the attachment holder comprising:

a movable-side pin guidance surface disposed outside the opening of the movable-side pin accommodation portion of the movable-side jaw and that is configured to come into contact with the movable-side coupling pin and guide the movable-side coupling pin until the movable-side coupling pin is accommodated in the movable-side pin accommodation portion whether the attachment has a minimum pin-to-pin spacing between the stationary-side coupling pin and the movable-side coupling pin or a maximum pin-to-pin spacing between the stationary-side coupling pin and the movable-side coupling pin; and an excessive closure prevention portion configured to prevent the movable-side jaw from closing excessively with respect to the stationary-side jaw to enable the movable-side coupling pin to come into contact with the movable-side pin guidance surface, whether the attachment has the minimum pin-to-pin spacing between the stationary-side coupling pin and the movable-side coupling pin or the maximum pin-to-pin spacing between the stationary-side coupling pin and the movable-side coupling pin, in a case in which the movable-side coupling pin is to be accommodated in the movable-side pin accommodation portion of the movable-side jaw by lowering the arm of the construction machine so as to move the movable-side jaw closer to the movable-side coupling pin after the stationary-side coupling pin is accommodated in the stationary-side pin accommodation portion of the stationary-side jaw, wherein, after the movable-side jaw is closed with respect to the stationary-side jaw until excessive closure is prevented by the excessive closure prevention portion, the arm of the construction machine is configured to be lowered without any operation of the bucket cylinder, thereby guiding the movable-side coupling pin into the movable-side pin accommodation portion, while the movable-side coupling pin is in contact with the movable-side pin guidance surface, whether the attachment has the minimum pin-to-pin spacing between the stationary-side coupling pin and the movable-side coupling pin or the maximum pin-to-pin spacing between the stationary-side coupling pin and the movable-side coupling pin, and opening the movable-side jaw with respect to the stationary-side jaw.

2. The attachment holder according to claim 1, further comprising an excessive opening prevention portion, wherein:

the stationary-side jaw and the movable-side jaw are configured to pivotally move about a pivot shaft, and the excessive opening prevention portion is configured to prevent the movable-side pin accommodation portion of the movable-side jaw from excessively opening pivotally about the pivot shaft with respect to the stationary-side pin accommodation portion of the stationary-side jaw; and the stationary-side jaw and the movable-side jaw are configured to pivotally move about the pivot shaft relative to each other by actuating the bucket cylinder disposed in the arm of the construction machine and thereby cause the stationary-side pin accommodation portion and the movable-side pin accommodation portion to move closer to, and away from, each other and enable the stationary-side pin accommodation portion to accommodate the stationary-side coupling pin and also enable the movable-side pin accommodation portion to accommodate the movable-side coupling pin.

3. The attachment holder according to claim 2, wherein:

the excessive closure prevention portion is part of a stopper that is welded to the stationary-side jaw at a position near the pivot shaft and that is contactable with a base portion of the movable-side jaw near the pivot shaft; and whether the attachment has the minimum pin-to-pin spacing between the stationary-side coupling pin and the movable-side coupling pin or the maximum pin-to-pin spacing between the stationary-side coupling pin and the movable-side coupling pin, the movable-side coupling pin is configured to be brought into contact with the movable-side pin guidance surface in a case in which the movable-side coupling pin is to be accommodated in the movable-side pin accommodation portion of the movable-side jaw by actuating a hydraulic cylinder of the construction machine so as to move the movable-side jaw closer to the movable-side coupling pin while the base portion of the movable-side jaw near the pivot shaft is in contact with the stopper of the stationary-side jaw after the stationary-side coupling pin is accommodated in the stationary-side pin accommodation portion of the stationary-side jaw.

4. The attachment holder according to claim 2, wherein:

the excessive closure prevention portion includes respective body portions of the stationary-side jaw and the movable-side jaw, the body portions opposing each other; and whether the attachment has the minimum pin-to-pin spacing between the stationary-side coupling pin and the movable-side coupling pin or the maximum pin-to-pin spacing between the stationary-side coupling pin and the movable-side coupling pin, the movable-side coupling pin is configured to be brought into contact with the movable-side pin guidance surface in a case in which the movable-side coupling pin is to be accommodated in the movable-side pin accommodation portion of the movable-side jaw by actuating a hydraulic cylinder of the construction machine so as to move the movable-side jaw closer to the movable-side coupling pin while a projection of the stationary-side jaw and the body portion of the movable-side jaw are in contact with each other after the stationary-side coupling pin is accommodated in the stationary-side pin accommodation portion of the stationary-side jaw.

5. A construction machine comprising
the attachment holder according to claim 1.

6. A construction machine comprising
the attachment holder according to claim 2.

7. A construction machine comprising
the attachment holder according to claim 3.

8. A construction machine comprising
the attachment holder according to claim 4.

* * * * *